US009919893B2

(12) United States Patent
Fukasawa et al.

(10) Patent No.: US 9,919,893 B2
(45) Date of Patent: Mar. 20, 2018

(54) SHEET PROCESSING DEVICE, IMAGE FORMING DEVICE PROVIDED WITH THE SAME, AND FOLDED SHEET PRESSING METHOD

(71) Applicants: Takeshi Fukasawa, Yamanashi-ken (JP); Hisashi Osada, Yamanashi-ken (JP); Akira Takei, Yamanashi-ken (JP)

(72) Inventors: Takeshi Fukasawa, Yamanashi-ken (JP); Hisashi Osada, Yamanashi-ken (JP); Akira Takei, Yamanashi-ken (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 126 days.

(21) Appl. No.: 14/750,469

(22) Filed: Jun. 25, 2015

(65) Prior Publication Data

US 2015/0375958 A1 Dec. 31, 2015

(30) Foreign Application Priority Data

Jun. 30, 2014 (JP) ..... 2014-133796
Jun. 30, 2014 (JP) ..... 2014-133798

(51) Int. Cl.
*B65H 45/18* (2006.01)
*B65H 23/16* (2006.01)

(52) U.S. Cl.
CPC ... *B65H 45/18* (2013.01); *B65H 2301/51232* (2013.01); *B65H 2701/13212* (2013.01); *B65H 2701/1829* (2013.01); *B65H 2801/27* (2013.01)

(58) Field of Classification Search
CPC ..... B65H 2701/13212; B65H 2301/51232; B65H 2301/4505; B65H 45/18; B65H 23/16
See application file for complete search history.

(56) References Cited

U.S. PATENT DOCUMENTS 7,431,274 B2 * 10/2008 Kushida ..... B65H 37/06 270/32
8,201,815 B2 * 6/2012 Sasahara ..... B65H 45/18 270/32

(Continued)

FOREIGN PATENT DOCUMENTS

JP 4217640 B2 2/2009
JP 4514217 B2 7/2010

(Continued)

*Primary Examiner* — Jennifer Simmons
(74) *Attorney, Agent, or Firm* — Manabu Kanesaka

(57) ABSTRACT

Provided is a sheet processing device capable of preventing a folded sheet bundle from being opened after pressing to improve accumulating property and aligning property of the sheet bundle. A sheet processing device includes: a pair of sheet pressing members 70 that press a fold of a folded sheet bundle in a thickness direction of the fold; and a moving member 56 that moves the sheet pressing member pair 70 along the fold of the folded sheet bundle. The moving member 56 supports a plurality of rows of the sheet pressing member pairs 70 arranged in a moving direction of the moving member 56. The sheet pressing member pairs 70 press the folded sheet bundle with the intervals therebetween in the respective rows reduced stepwise in the moving direction of the moving member 56.

16 Claims, 23 Drawing Sheets

(56) References Cited

U.S. PATENT DOCUMENTS

2009/0010737 A1* 1/2009 Li ..... B42C 13/003
412/4
2011/0176891 A1* 7/2011 Urano ..... B42C 1/12
412/22

FOREIGN PATENT DOCUMENTS

JP 2012-201462 A 10/2012
JP 2014-076903 A 5/2014

* cited by examiner

SHEET PROCESSING DEVICE, IMAGE FORMING DEVICE PROVIDED WITH THE SAME, AND FOLDED SHEET PRESSING METHOD

BACKGROUND OF THE INVENTION

Field of the Invention

The present invention relates to a device for folding a sheet bundle formed by sheets that are sequentially carried out from an image forming device such as a copier or a printer and accumulated in a bundle and, more particularly, to a sheet processing device that performs pressing against a fold of a two-folded sheet bundle.

Description of the Related Art

There are widely known processing devices that align sheets carried out from an image forming device, bind them, and fold them into a booklet. Among them, some processing devices are configured to saddle-stitch the sheet bundle with a staple or an adhesive and fold the sheet bundle into a booklet.

Such a device performs folding for sheet bundle formed by about 20 to 30 sheets in half; however, there may be a case where the two-folded sheet bundle is unintentionally opened after being discharged from the device, degrading aligning property of the sheet bundle, which results in reduction in accumulation amount.

Thus, it is widely known that, after the folding, the two-folded sheet bundle is subjected to pressing from above and below the fold.

For example, Japanese Patent No. 4,217,640 discloses a device that moves along a fold of a two-folded sheet bundle while pinching/pressing the fold by means of rollers disposed above and below the fold. This device is also provided with a flattening roller that presses the fold from a front side thereof at a position slightly rearward of the pinching/pressing position of the upper and lower rollers. That is, in this device, the rollers that pinch/press the fold from thereabove and therebelow and flattening roller that presses the fold from the front side thereof are formed into one unit, and this unit is moved along the sheet folding direction. Thus, only a portion that is pinched by the rollers can be made flat, thereby reducing wrinkles and breaks of a portion other than the fold due to a difference in gripping force.

Further, as illustrated in detail in FIGS. 11 and 12, Japanese Patent No. 4,217,640 discloses, as a device of a second embodiment of the specification, a device in which a unit provided with a flattening roller that presses the fold from the front side thereof and pinching roller pairs that are arranged at front and rear of the flattening roller so as to pinch/press the fold from thereabove and therebelow moves along the sheet folding direction. A device of such a type moves from outside one end portion of the sheet bundle in its width direction toward inside and passes the other end portion thereof while pinching/press the fold by means of the pinching roller pairs to thereby flatten a back-folded portion.

Further, Jpn. Pat. Appln. Laid-Open Publication No. 2014-76903 discloses a processing device provided with a pair of pressing rollers that press a fold of a two-folded sheet bundle in a sheet width direction and a moving unit that reciprocates the pressing roller pair in the sheet width direction. Further, this processing device is configured to move the pressing roller pair between a position where they are separated away from each other and a position where they are brought into pressure contact with each other. Upon pressing the sheet bundle, the moving unit moves inward from an end portion in the sheet width direction with the pressing roller pair separated away from each other and then moves from the inside to one end portion of the sheet bundle while pressing the sheet bundle. After passing the one end portion, pressing by the pressing roller pair is released to separate the pressing roller pair away from each other. When moving again for pressing, the moving unit passes the one end position of the sheet bundle with the pressing roller pair separated away from each other and then moves from the inside to the other end portion of the sheet bundle while pressing the sheet bundle. In other words, the pressing against the fold of the sheet bundle is started from the inside in the sheet width direction to the one or the other end portion of the sheet bundle.

The above-described devices that perform pressing against the folded sheet bundle carried out from an image forming device or the like have the following problems, respectively.

In the device disclosed in Japanese Patent No. 4,217,640, the roller pair that is previously brought into a pressure contact state is moved along the fold, so that even if the roller pair is reciprocated many times, the roller pair presses the same position, that is, the folded positions are overlapped in a straight line, with the result that the folded sheet bundle may be opened after the pressing. Thus, an accumulating property and an aligning property of the folded sheet bundle cannot be effectively improved.

Also, in the device disclosed in Jpn. Pat. Appln. Laid-Open Publication No. 2014-76903, the pressing against the fold of the sheet bundle by means of the pressing roller pair is repetitively performed with the same pressing force, so that, as in the case of the device disclosed in Japanese Patent No. 4,217,640, the folded positions are overlapped in a straight line, with the result that the folded sheet bundle may be opened after the pressing. Thus, improvement of the accumulating property and aligning property of the folded sheet bundle is conventionally difficult to achieve.

SUMMARY OF THE INVENTION

The present invention has been made in view of the above problems and based on the following idea. That is, when a fold of a folded sheet bundle is subjected to pressing, a plurality of pressing operations are not made for the same position of the fold but for different positions in a thickness direction of the fold, with the result that created fold lines are directed inward in the sheet thickness direction after the last pressing operation.

To solve the above problem, a sheet processing device according to the present invention includes: a pair of sheet pressing members that press a fold of a folded sheet bundle in a thickness direction of the fold; and a moving member that moves the sheet pressing member pair along the fold of the folded sheet bundle. The moving member supports a plurality of rows of the sheet pressing member pairs arranged in a moving direction of the moving member. The sheet pressing member pairs press the folded sheet bundle with the intervals therebetween in the respective rows reduced stepwise in the moving direction of the moving member.

The present invention provides the following effects by having the above features.

The first sheet pressing roller pair in the moving direction is moved in a sheet width direction while pressing the folded sheet bundle in the fold thickness direction in a state of being separated from each other to create a fold, and the second sheet pressing roller pair in the moving direction is moved in the sheet width direction while pressing the folded sheet bundle with the interval therebetween reduced to create a new fold, whereby the fold of the folded sheet bundle is directed inward. Thus, the sheet bundle itself is directed to its binding direction, thereby preventing the folded sheet bundle from being opened after the pressing, which allows more sheet bundles to be accumulated.

BRIEF DESCRIPTION OF THE DRAWINGS

FIGS. 21A to 21C are explanatory views illustrating a folded sheet bundle having a plurality of fold lines as a result of pressing performed by the pressing roller unit of FIGS. 8 to 10 or pressing roller units of FIGS. 16 to 20 of the second embodiment, in which FIG. 21A is a view illustrating a state where the folded sheet bundle is pressed between the first upper and lower pressing rollers, FIG. 21B is a view illustrating a state where the folded sheet bundle is pressed between the second upper and lower pressing rollers, and FIG. 21C is a view illustrating a state where the folded sheet bundle is pressed between the third upper and lower pressing rollers;

DESCRIPTION OF THE PREFERRED EMBODIMENTS

Figure 1:
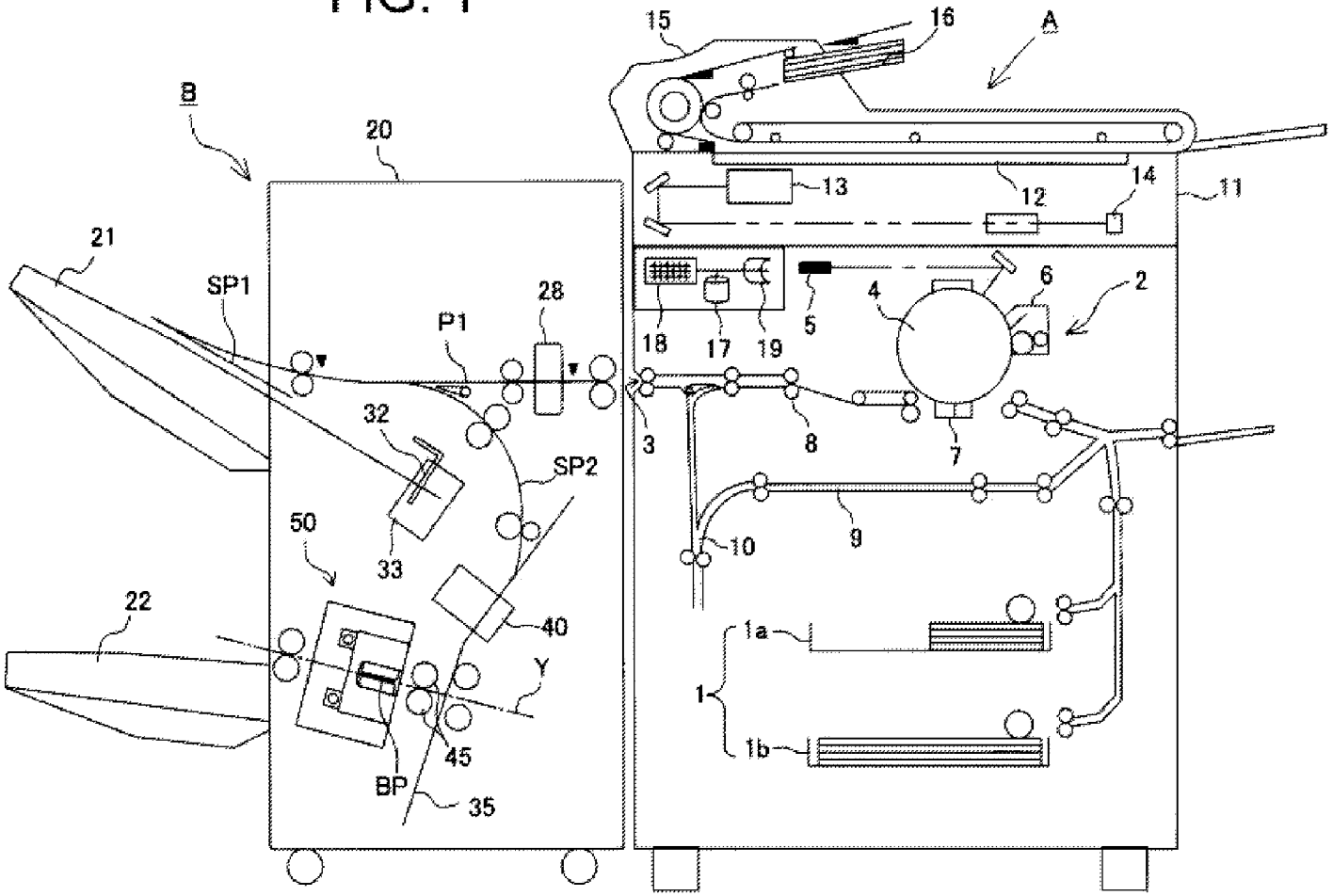
FIG. 1 is an explanatory view of an entire configuration of an image forming system according to the present invention constituted by an image forming device and a sheet processing device incorporating a sheet pressing device.
Figure 2:
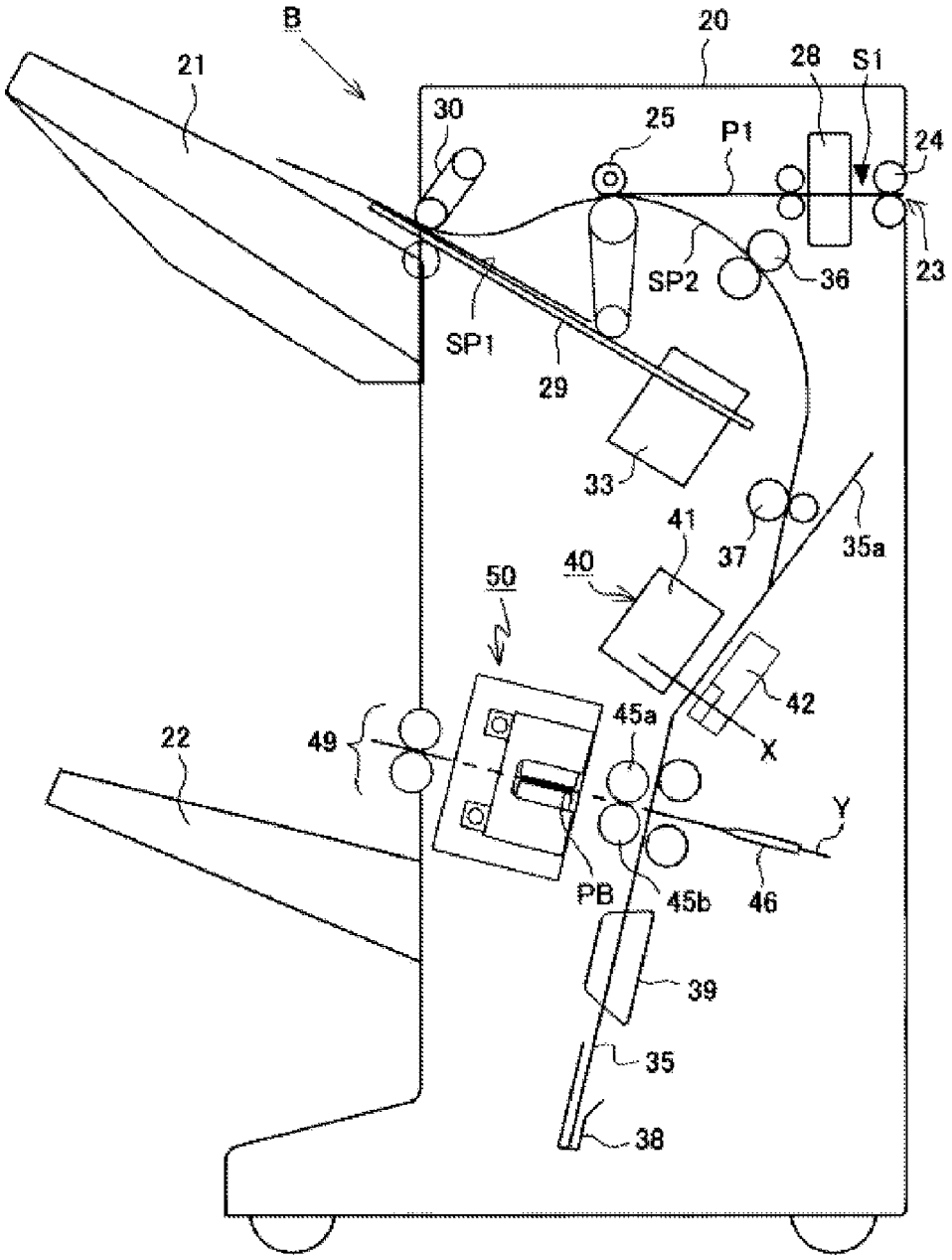
FIG. 2 is an explanatory view of an entire configuration of the sheet processing device according to the present invention that incorporates the sheet pressing device.
Figure 3A:
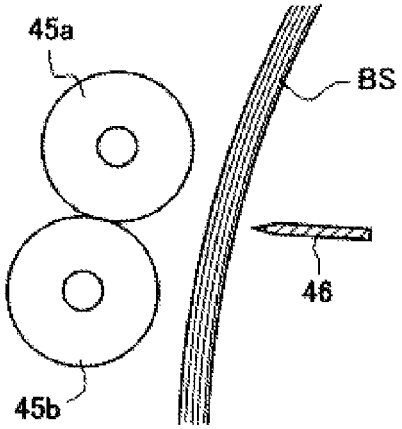
FIGS. 3A to 3D are explanatory views of folding processing performed by a folding roller in the sheet processing device.
Figure 3B:
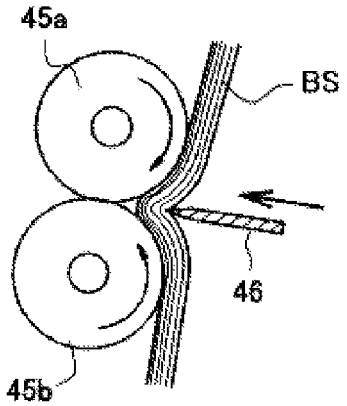
Figure 4:
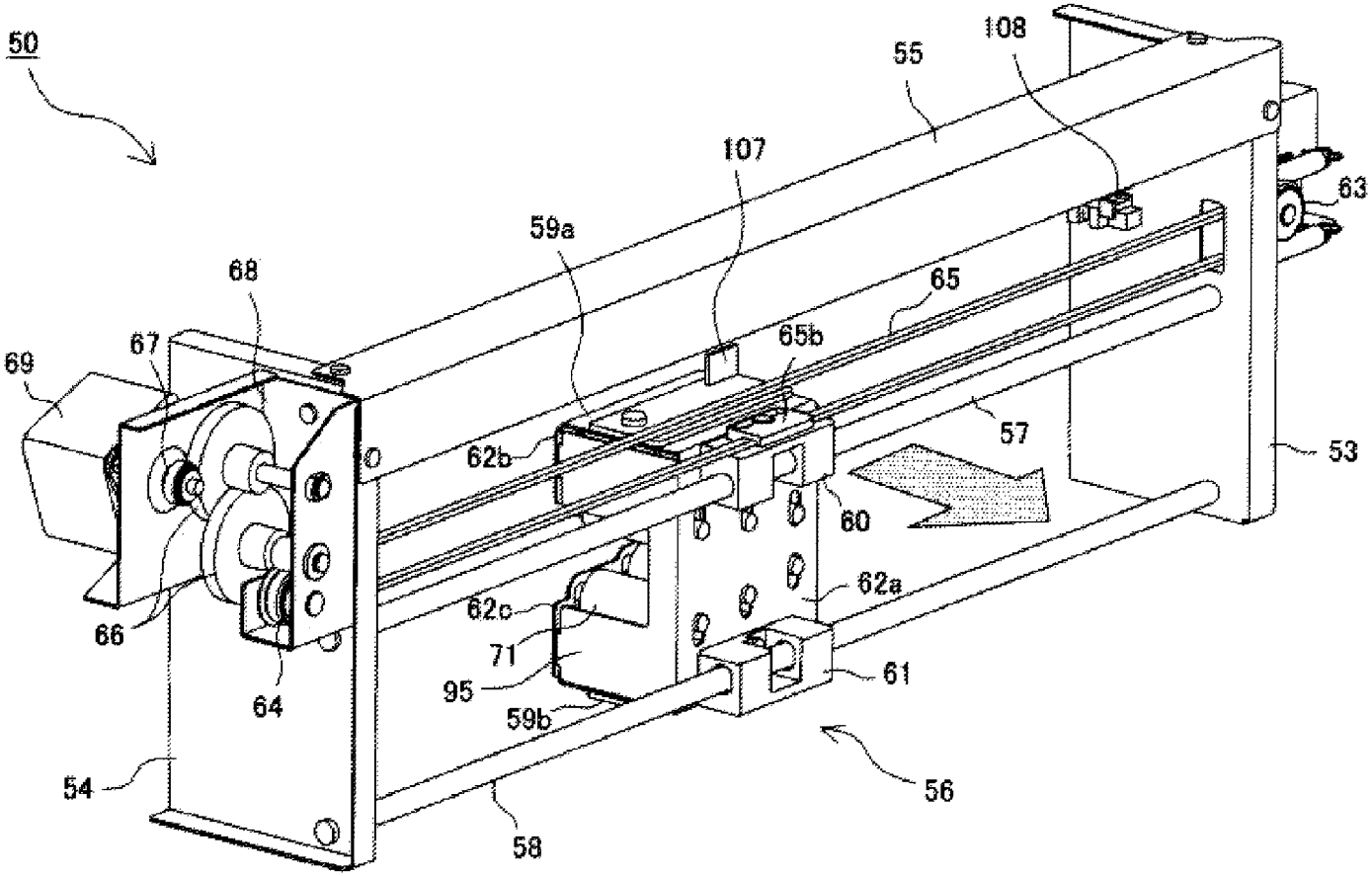
FIG. 4 is a perspective view of the sheet pressing device of FIG. 2 as viewed from a bundle discharge roller side.
Figure 5:
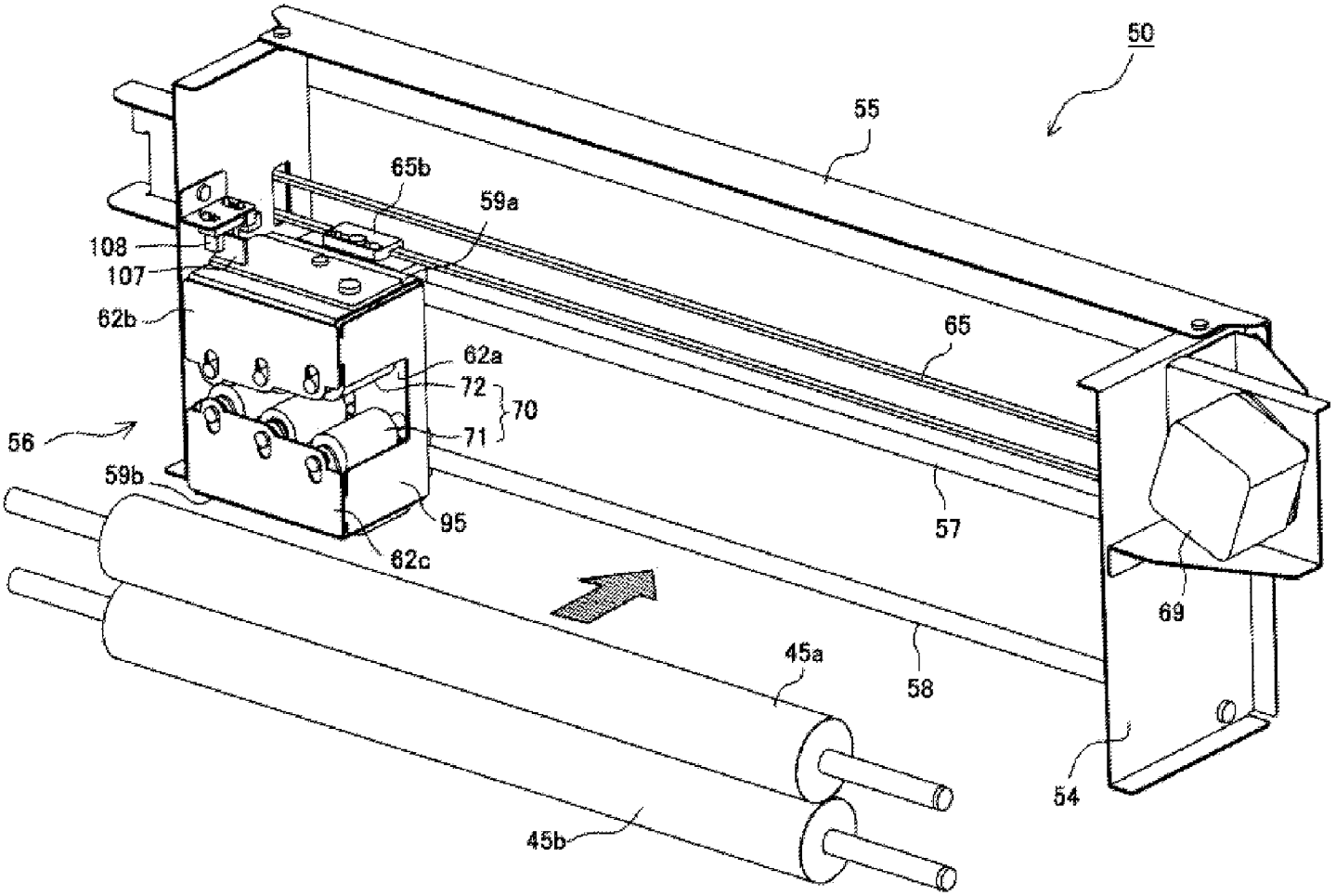
FIG. 5 is a perspective view of the sheet pressing device of FIG. 2 as viewed from a folding roller side.

Hereinafter, the present invention will be described in detail based on illustrated embodiments. FIG. 1 illustrates an entire configuration of an image forming system according to the present invention including an image forming device, FIG. 2 is an explanatory view of an entire configuration of a sheet processing device, and FIGS. 3A to 3D are views explaining a folded state of a sheet bundle in the sheet processing device. FIG. 4 is a perspective view of a sheet pressing device incorporated in the sheet processing device as viewed from a discharge roller side, and FIG. 5 is a perspective view of the sheet pressing device as viewed from a folding roller side.

The image forming system illustrated in FIG. 1 is constituted by an image forming device A and a sheet processing device B, and a sheet pressing device 50 is incorporated in the sheet processing device B.

[Configuration of Image Forming Device]

The image forming device A illustrated in FIG. 1 feeds a sheet from a sheet supply section 1 to an image forming section 2, performing printing for the sheet in the image forming section 2, and carries out the resultant sheet from a main body sheet discharge port 3. In the sheet supply section 1, sheets of a plurality of sizes are housed in sheet cassettes 1*a* and 1*b*, respectively, and sheets of a specified size are fed to the image forming section 2 while being separated one from another. The image forming section 2 includes, for example, an electrostatic drum 4, a print head (laser emitter) 5, a developing unit 6, a transfer charger 7, and a fixing unit 8. The print head 5, developing unit 6, transfer charger 7, and fixing unit 8 are disposed around the electrostatic drum 4. In this image forming section 2, the laser emitter 5 forms an electrostatic latent image on the electrostatic drum 4, the developing unit 6 makes toner adhere to the obtained electrostatic latent image, the transfer charger 7 transfers an image onto the sheet, and the fixing unit 8 thermally fixes the image to the sheet. The sheets with the thus formed image are sequentially carried out from the main body sheet discharge port 3. A reference numeral 9 is a circulation path for double-sided printing. More specifically, the sheet on a front side of which the image has been printed is fed from the fixing unit 8, reversed in a main body switchback path 10, and enters the circulation path 9, along which the sheet is fed once again to the image forming section 2 for printing on a back side of the sheet. The thus double-side printed sheet is reversed in the main body switchback path 10 and carried out from the main body sheet discharge port 3.

A reference numeral 11 is an image reading device. The image reading device 11 scans a document sheet set on a platen 12 using a scan unit 13, and light reflected from the document and passing through a reflective mirror and a condenser lens is electrically read by a photoelectric conversion element 14. This image data is subjected to, e.g., digital processing in an image processing section, transferred to a data storage section 17, from which an image signal corresponding to the resultant image data is transmitted to the laser emitter 5. A reference numeral 15 is a document feeder that feeds a document sheet housed in a document stacker 16 to the platen 12.

A controller is provided in the image forming device A having the above configuration, and image formation conditions, for example, print-out conditions such as sheet size designation, color/monochrome printing designation, number-of-copies designation, one-side/two-side printing designation, and scaling printing designation are set through a control panel 18. Further, in the image forming device A, image data read by the scan unit 13 or image data transferred from an external network is stored in the data storage section 17. The image data is transferred from the data storage section 17 to a buffer memory 19, from which data signals corresponding to the image data are sequentially transmitted to the laser emitter 5.

Upon input of the image formation conditions, sheet processing conditions are also input (designated) through the control panel 18. Through input of the sheet processing conditions, the following modes are designated. The image forming device A forms an image on the sheet according to the image formation conditions and post processing conditions.

[Configuration of Sheet Processing Device]

The sheet processing device B connected to the above-described image forming device A is configured to receive the image-formed sheet from the main body sheet discharge port 3 of the image forming device A and perform sheet processing according to one of the following modes.

The modes include: (1) "print-out mode" in which the image-formed sheet is housed in a first sheet discharge tray 21; (2) "staple-binding mode" in which the sheets from the main body sheet discharge port 3 are aligned in a bundle, bound by an end face stapler 33, and housed in the first sheet discharge tray 21; (3) "saddle stitching and folding mode" in which the sheets from the main body sheet discharge port 3 are aligned in a bundle in a stacker section 35 which is a second processing tray, bound at a portion near a center thereof using a saddle stitching stapler 40, folded into a booklet, and stored in a second sheet discharge tray 22; and (4) "folded sheet pressing mode" in which a sheet loop is pressed at a fold of a sheet bundle that has been saddle-stitched and folded into a booklet and then stored in the second sheet discharge tray 22.

As illustrated in FIG. 2, the sheet processing device B includes, in a casing 20 thereof, the first and second sheet discharge trays 21 and 22 and a sheet carry-in path P1 having a carry-in port 23 connected to the main body sheet discharge port 3. The sheet carry-in port P1 is constituted by a straight line path extending in a substantially horizontal direction. Further, first and second switchback conveying paths SP1 and SP2 are branched from the sheet carry-in path P1, along which the sheet is conveyed in a reverse direction to the conveying direction of the sheet conveyed on the sheet carry-in path P1. The first switchback conveying path SP1 is branched from the sheet carry-in path P1 at a path downstream side, and the second switchback path SP2 is branched from the sheet carry-in path P1 at a path upstream side. The first and second switchback conveying paths SP1 and SP2 are distanced from each other.

In such a path configuration, in the sheet carry-in path P1, there are disposed a carry-in roller 24 and a sheet discharge roller 25. The sheet discharge roller 25 is configured to be rotatable in normal and reverse directions. Further, in the sheet carry-in path P1, there is disposed a path switching piece (not illustrated) for guiding the sheet to the second switchback conveying path SP2, and the piece is coupled to an operation means such as a solenoid. Further, the sheet carry-in path P1 has, on the downstream side of the carry-in roller 24, a stamp means for performing stamping on the sheet fed from the carry-in port 23 or a single-sheet punching unit 28 for punching the sheets fed from the carry-in port 23 one by one.

[Configuration of First Switchback Conveying Path SP1]

The first switchback conveying path SP1 disposed on the downstream side (rear end portion of the device) of the sheet carry-in path P1 as illustrated in FIG. 2 is configured as described below. The sheet carry-in path P1 is provided, at its exit end, with the sheet discharge roller 25 and a processing tray 29 on which the sheets fed by the sheet discharge roller 25 are stacked and supported. There is disposed, above the processing tray 29, a normal/reverse rotation roller 30 capable of moving up and down between a position to come into contact with the sheet on the tray and a standby position spaced apart therefrom. The normal/reverse rotation roller 30 is controlled to rotate in a clockwise direction in FIG. 2 when the sheet approaches the processing tray 29 to which the normal/reverse rotation roller 30 is coupled, and to rotate in a counterclockwise direction after a sheet rear end passing through the sheet discharge roller 25 enters the processing tray 29. Thus, the first switchback conveying path SP1 is positioned above the processing tray 29.

Further, the first sheet discharge tray 21 is located downstream of the first switchback conveying path SP1 and is configured to support a leading end of the sheet to be guided to the first switchback conveying path SP1 and the second switchback conveying path SP2.

An end face stapler 33 is disposed at a rear end portion of the processing tray 29 in the sheet discharge direction. The illustrated end face stapler 33 staples a sheet bundle on the processing tray 29 at one or more positions of a rear end edge of the sheet bundle. The staple-bound sheet bundle is discharged onto the first sheet discharge tray 21.

The first switchback conveying path SP1 configured as described above aligns the sheets fed by the sheet discharge roller 25 on the processing tray 29 in the "(2) staple-binding mode" as described above, and the end face stapler 33 staples the sheet bundle at one or more portions of the rear end edge of this sheet bundle. In the "(1) print-out mode", the sheet fed by the sheet discharge roller 25 is not subjected to the switchback, but conveyed along the processing tray 29 and discharged to the first sheet discharge tray 21 by a rotation of the normal/reverse rotation roller 30 in a clockwise direction in FIG. 2.

[Configuration of Second Switchback Conveying Path SP2]

The following describes a configuration of the second switchback conveying path SP2 branched from the sheet carry-in path P1. The second switchback conveying path SP2 is a conveying path for guiding a switchback-conveyed sheet. That is, in a state where the sheet is nipped by the sheet discharge roller 25, rotation of the sheet discharge roller is changed from the normal rotation to the reverse rotation, with the result that the sheet is switchback-conveyed along the switchback conveying path SP2. As illustrated in FIG. 2, the second switchback conveying path SP2 is located in a substantially vertical direction inside the casing 20. A conveying roller 36 is located at an inlet of the second switchback conveying path SP2, and an exit conveying roller 37 is located at an outlet of the second switchback conveying path SP2. A stacker section 35 constituting a second processing tray that aligns and temporarily stacks the sheets fed along the second switchback conveying path SP2 is provided downstream of the second switchback conveying path SP2. The illustrated stacker section 35 includes a conveying guide that transfers the sheet. A saddle stitching stapler 40 and a folding roller 45 are arranged along the stacker section 35. The configuration of these components will be sequentially described below.

[Configuration of Stacker Section]

The stacker section 35 is formed of a guide member that guides the sheet being conveyed. The stacker section is configured such that the sheets are stacked and housed thereon. The illustrated stacker section 35 is connected to the second switchback conveying path SP2 and located in a center portion of the casing 20 so as to extend in the substantially vertical direction. This allows the device to be compactly configured. The stacker section 35 is shaped to have an appropriate size to house maximum sized sheets. In particular, the illustrated stacker section 35 is curved or bent so as to project toward an area in which the saddle stitching stapler 40 and the folding roller 45 to be described later are arranged.

A switchback approaching path 35*a* is connected to a conveying direction rear end of the stacker section 35. The switchback approaching path 35*a* overlaps the outlet end of the second switchback conveying path SP2. This is to allow the leading end of a carried-in (succeeding) sheet fed from the exit conveying roller 37 on the second switchback conveying path SP2 to overlap the rear end of the stacked (preceding) sheets supported on the stacker section 35 to ensure the page order of the stacked sheets. A leading end regulating member (hereinafter, referred to as stopper 38) regulating a sheet leading end of the sheet in the conveying direction is located downstream of the stacker section 35. The stopper 38 is supported by a guide rail and the like so as to be movable along the stacker section 35. The stopper 38 is configured to be movable to a position where the sheet is carried in the stacker section 35 by means of a not illustrated shift means, a position where the sheet bundle is bound at a center thereof in the stacking direction, and a position where the sheet bundle is folded by the folding roller 45. Further, an aligning means 39 for aligning the sheets is provided in the middle of the stacker section 35 in the sheet conveying direction. The aligning means 39 presses a side edge of the sheet for alignment every time the sheet is carried in.

[Saddle Stitching Stapler]

The saddle stitching stapler 40 positioned above the stacker section 35 includes a driver unit 41 and a clincher unit 42 which are arranged opposite to each other with respect to the stacker section 35. The driver unit 41 drives a staple into a sheet bundle. The clincher unit 42 bends leg portions of the driven staple in a direction facing each other. With this configuration, the sheet bundle is bound at a binding position X illustrated in FIG. 2 corresponding to the half of a sheet length. The saddle stitching stapler 40 may perform the binding not only by using a metallic staple, but also by using a paper-made staple, by performing press-bonding (without use of the metallic or paper-made staple), or by forming a cut in the paper sheets (without use of the metallic or paper-made staple).

[Folding Roller]

The following describes a configuration of the folding roller 45. As illustrated in FIG. 2, the folding roller 45 for folding the sheet bundle and a folding blade 46 for inserting the sheet bundle into a nip position of the folding roller 45 are disposed at a folding position Y set on the downstream side of the above-described saddle stitching stapler 40. As illustrated in FIGS. 3A to 3D, the folding roller 45 is constituted by an upper pressure contact roller 45*a* and a lower pressure contact roller 45*b* which are brought into pressure contact with each other. The upper and lower pressure contact rollers 45*a* and 45*b* each have a length slightly longer than the maximum width of the sheet. The folding roller pair 45 are biased in the pressure contact direction by a not illustrated compression spring. The folding roller pair 45 are each formed of a material, such as rubber, having a comparatively large friction coefficient.

Further, the folding blade 46 configured to be moved toward the pressure contact position of the folding roller pair 45 is disposed so as to be capable of advancing and retreating. After the sheet bundle is saddle-stitched by the saddle stitching stapler 40, the folding blade 46 is moved to push the binding position between the folding roller pair 45 to cause the folding roller pair 45 to be rotated while pressed against each other, whereby the saddle-stitched sheet bundle is center-folded. In the middle of the above folding processing, the folding blade 46 is returned to its original position and waits for the next sheet bundle. A movement path along which the folding blade 46 is moved is illustrated as the folding position Y which coincides with the binding position X of the sheet bundle.

Hereinafter, a procedure of folding processing of the stacked sheet bundle or stacked and saddle-stitched sheet bundle will be described using FIGS. 3A to 3D. The sheets are stopped by the stopper 38 and stacked as a sheet bundle. Then, the stopper 38 is moved upward to allow the saddle stitching stapler 40 to saddle-stitch the sheet bundle at about a center position of the sheet bundle in the sheet conveying direction. After the saddle stitching, the stopper 38 supporting the resultant sheet bundle is moved down and stopped at a position where the sheet binding position coincides with a folding position. This state is illustrated in FIG. 3A. This position coincides with the pressure contact position between the upper and lower pressure contact rollers 45*a* and 45*b* constituting the folding roller 45. Thereafter, the upper and lower pressure contact rollers 45*a* and 45*b* are rotated in the same direction by a not illustrated drive motor, and the folding blade 46 is moved so as to be pushed to the pressure contact position. This state is illustrated in FIG. 3B.

Figure 3C:
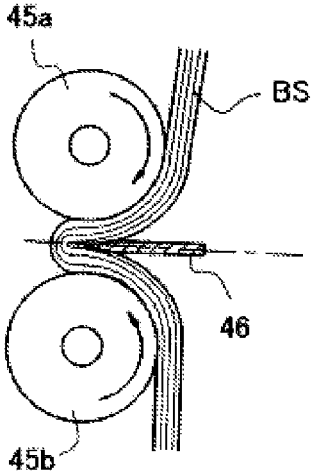
Figure 3D:
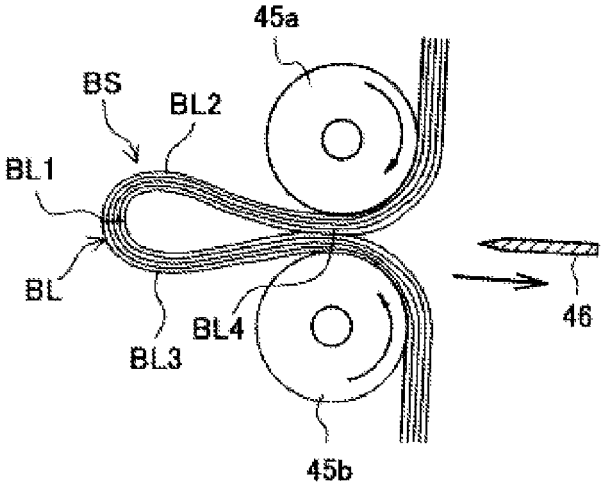

Then, as illustrated in FIG. 3C, the upper and lower pressure contact rollers 45*a* and 45*b* continue being rotated in the same direction, while the folding blade 46 is once stopped before the pressure contact position. Then, the folding blade 46 is retracted in a returning direction. Afterward, when the upper and lower pressure contact rollers 45*a* and 45*b* are further rotated in the same direction, a folded sheet bundle BS to be folded is folded while forming a certain loop BL as illustrated in FIG. 3D. In this state, there are formed a folding loop leading end BL1 which is a fold formed as a result of pushing of the folding blade 46, an upper loop BL2 swelling upward with the folding loop leading end BL1 as a center, a lower loop BL3 swelling downward, and a loop base end portion BL4 that presses the sheets so as to maintain the loop, and the folding operation is once stopped.

The loop at the fold is generated due to action of force for the sheet bundle to be opened outward. Thus, the larger the number of the sheet bundle BS to be folded, the greater the force for the sheet bundle itself to be opened and spread. Accordingly, if no countermeasure is taken, a discharged sheet bundle is opened. So, in the present invention, sheet pressing to be described below is performed.

The folding roller 45 may be used for detecting a thickness of the sheet bundle BS to be folded. That is, by measuring a difference between a distance between axes of the upper and lower pressure contact rollers 45*a* and 45*b* in a state where the sheet bundle BS is not inserted and a distance therebetween in a state where the sheet bundle BS is inserted, the thickness of the sheet bundle BS can be detected.

[Sheet Pressing Device]

Figure 6:
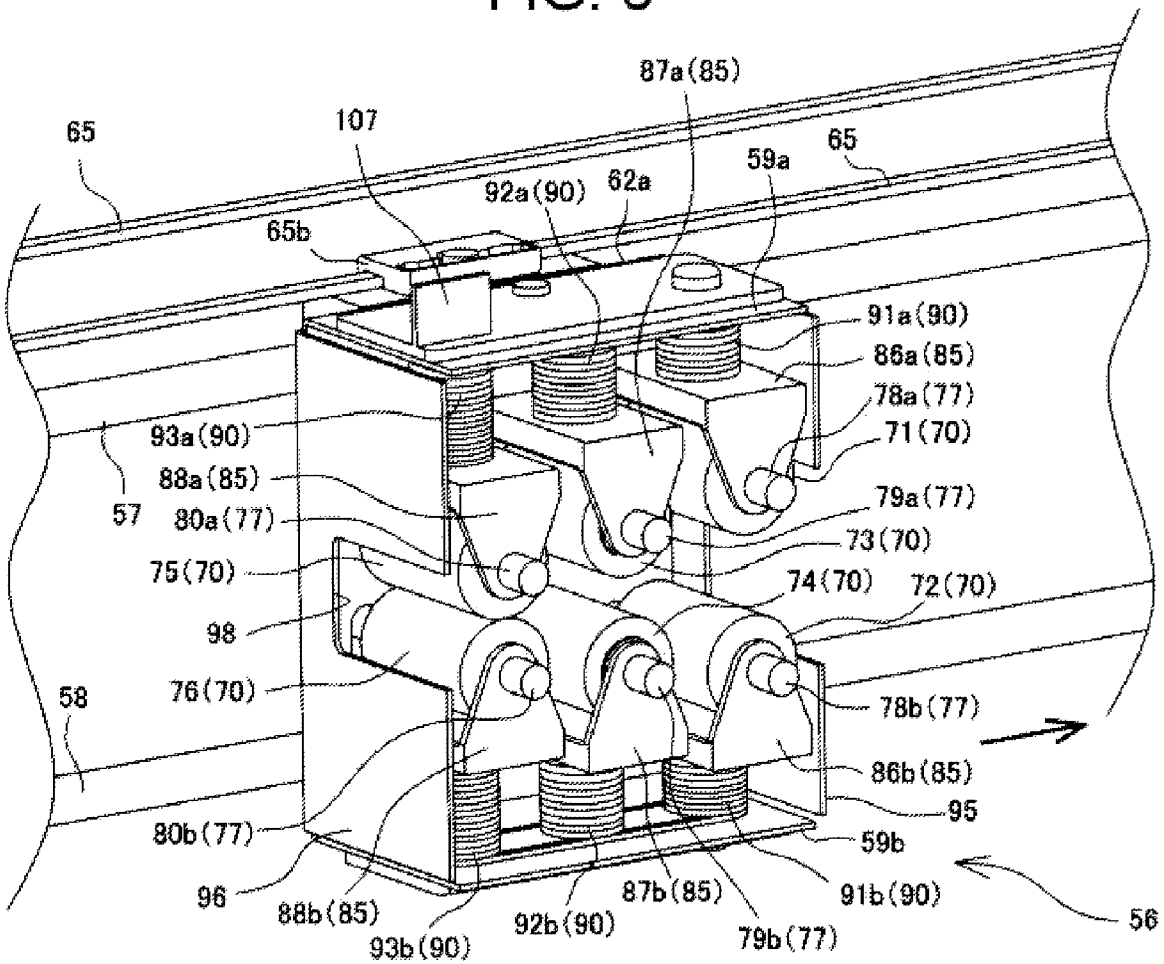
FIG. 6 is an explanatory view illustrating an inside of a pressing roller unit in the sheet pressing device of FIG. 4.
Figure 7:
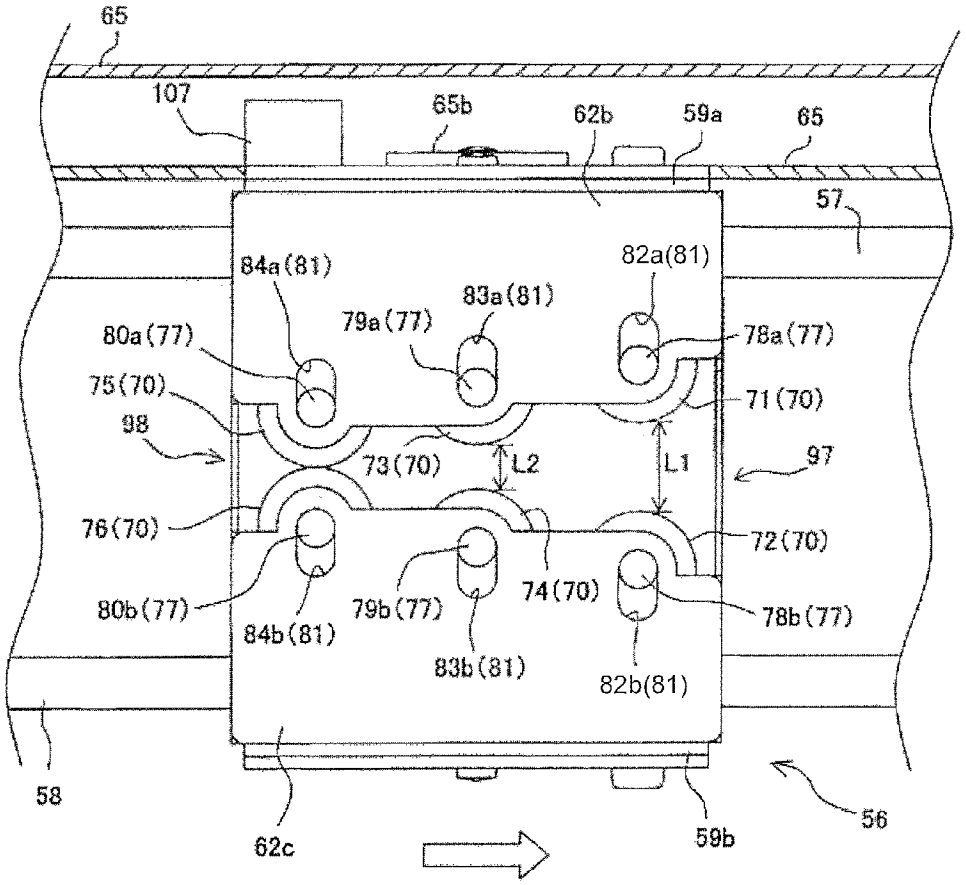
FIG. 7 is a front view of the pressing roller unit in the sheet pressing device of FIG. 4 as viewed from the folding roller side.

Hereinafter, the sheet pressing device 50 constituting a part of the sheet processing device according to the present invention will be described. The sheet pressing device 50 is a device for preventing the folded sheet bundle BS from being opened. First, a configuration of the sheet pressing device 50 will be described with reference to FIGS. 5 to 7, followed by description of operation thereof with reference to FIGS. 8 to 10. FIG. 4 is a perspective view of the sheet pressing device 50 as viewed from the sheet discharge side, FIG. 5 is a perspective view of the sheet pressing device 50 as viewed from the folding roller 45 side, FIG. 6 is a perspective view of a pressing roller unit 56 as viewed from the folding roller 45 side, and FIG. 7 is a front view of the pressing roller unit 56 as viewed from the folding roller 45 side.

As illustrated in FIG. 2, the sheet pressing device 50 is disposed so as to cross a folded sheet conveying path PB installed downstream of the folding roller 45. More in detail, the sheet pressing device 50 performs pressing for the sheet bundle BS folded in two by the folding roller 45. The sheet pressing device 50 faces the fold of the folded sheet bundle BS having the fold in the sheet width direction and a certain loop.

The sheet pressing device 50 illustrated in FIG. 2 is installed between the folding roller 45 and a bundle discharge roller 49 that discharges the sheet bundle BS outside the device; alternatively however, the sheet pressing device 50 may be disposed downstream of the bundle discharge roller 49 as long as it crosses the folded sheet conveying path PB.

As illustrated in FIG. 4, in the sheet pressing device 50, a right side plate 53 disposed at one side of the device, a left side plate 54 disposed facing the right side plate 53, and a connecting angle 55 connecting the right side plate 53 and the left side plate 54 constitute the entire frame of the device. A pressing roller unit 56 is disposed between the right side plate 53 and the left side plate 54 so as to be reciprocated therebetween. The pressing roller unit 56 configured to be reciprocated is slidably moved along an upper guide rail 57 and a lower guide rail 58 extending between the right side plate 53 and the left side plate 54. More specifically, the pressing roller unit 56 is supported such that an upper slide block 60 attached to an upper portion of the pressing roller unit 56 is slid along the upper guide rail 57 and a lower slide block 61 attached to a lower portion of the pressing roller unit 56 is slid along the lower guide rail 58.

A moving belt 65 is provided above the pressing roller unit 56 so as to be stretched between the right side plate 53 and the left side plate 54. A right pulley 63 that winds the moving belt 65 is provided at the right side plate 53 side, and a left pulley 64 that winds the moving belt 65 is provided at the left side plate 54 side. One end of the moving belt 65 is fixed to a belt fixing portion 65*b* at an upper end of the pressing roller unit 56. Thus, when the moving belt 65 is moved to move the belt fixing portion 65*b* from a device back side (right side) to a device front side (left side), the pressing roller unit 56 is moved from the device back side (right side) to the device front side (left side) along the upper guide rail 57 and the lower guide rail 58. When the moving belt 65 is moved in the opposite direction, the belt fixing portion 65*b* is also moved in the opposite direction, which moves the pressing roller unit 56 in the opposite direction.

The left pulley 64 that winds the moving belt 65 is mounted to a motor gear unit 68 provided on the left side plate 54 and connected to a drive motor 69 configured to be rotatable in normal and reverse directions through the motor gear unit 68. Rotation drive of the drive motor 69 is transmitted from a motor output gear 67 to a transmission gear 66 provided in the motor gear unit 68, and then to the left pulley 64 of the moving belt 65. Thus, selecting a rotating direction of the drive motor 69 allows the pressing roller unit 56 to be moved selectively in the directions from the device back side (right side) to the device front side (left side) and from the device front side (left side) to the device back side (right side). A unit flag 107 is provided near a right side plate 53 side end portion on an upper surface of the pressing roller unit 56. The unit flag 107 indicates that the pressing roller unit 56 is situated at a home position near the right side plate 53. When the unit flag 107 is detected by a home position sensor 108, it can be determined that the pressing roller unit 56 is situated at the home position. When the pressing roller unit 56 is moved to the left in FIG. 4 from the home position, a position of the pressing roller unit is discriminated by a not illustrated pulse generator incorporated in the drive motor 69, whereby it is determined that the pressing roller unit 56 is situated at a returning position near the left side plate 54. When the pressing roller unit 56 is situated at the returning position, the drive motor 69 is rotated in the reverse direction to move the pressing roller unit 56 toward the home position. Thus, the pressing roller unit 56 is a moving member that is moved by means of the moving belt 65 and the like.

[Pressing Roller Unit]

The following describes the pressing roller unit 56 configured to be moved to the left and right in FIG. 4. As illustrated in FIG. 5, which is a perspective view as viewed from the folding roller 45 side, the pressing roller unit 56 is surrounded by a unit base plate 62*a* constituting a back surface side of the unit, front upper and lower base plates 62*b* and 62*c* which are separated up and down, a preceding unit side plate 95, a following unit side plate 96, a unit top plate 59*a*, and a unit bottom plate 59*b*. The preceding unit side plate 95 has a preceding side plate opening 97 having a comparatively large size, and the following unit side plate 96 has a following side plate opening 98 having a size smaller than the preceding side plate opening 97. These openings 97 and 98 allow the pressing roller unit 56 to be moved along the fold of the sheet bundle with the fold inserted into the pressing roller unit 56.

As illustrated in detail in FIG. 6, inside the pressing roller unit 56, three rows of pressing roller pairs are arranged from the preceding unit side plate 95 side toward the following unit side plate 96. An interval between the pair of pressing rollers 70 differs among the rows. That is, the pressing rollers 70 of a first row includes a first upper pressing roller 71 and a first lower pressing roller 72 which are disposed opposite to each other and spaced apart from each other by a predetermined interval. The first upper and lower pressing rollers 71 and 72 have a first upper pressing roller shaft 78*a* and a first lower pressing roller shaft 78*b*, respectively. The first upper and lower pressing roller shafts 78*a* and 78*b* are supported by a first upper pressing roller bracket 86*a* and a first lower pressing roller bracket 86*b*, respectively. The first upper pressing roller bracket 86*a* is vertically movably supported by the unit top plate 59*a*, and the first lower pressing roller bracket 86*b* is vertically movably supported by the unit bottom plate 59*b*.

Further, a first upper pressing roller pressing spring 91*a* is interposed between the first upper pressing roller bracket 86*a* and the unit top plate 59*a* so as to bias the first upper pressing roller bracket 86*a* and the unit top plate 59*a* in a direction separating them from each other; similarly, a first lower pressing roller pressing spring 91*b* having the same function as the first upper pressing roller pressing spring 91*a* is interposed between the first lower pressing roller bracket 86*b* and the unit bottom plate 59*b*. With this configuration, the first upper pressing roller 71 and the first lower pressing roller 72 are always biased in a direction approaching each other. On the other hand, a first upper pressing roller shaft elongated hole 82*a* is formed in the unit base plate 62*a* and front upper base plate 62*b* that support the first upper pressing roller shaft 78*a*. Thus, the biasing force of the first upper pressing roller pressing spring 91*a* is regulated by the first upper pressing roller shaft elongated hole 82*a*, and downward movement of the first upper pressing roller 71 is also regulated by the first upper pressing roller shaft elongated hole 82*a*. Further, the biasing force of the first lower pressing roller pressing spring 91*b* is regulated by a first lower pressing roller shaft elongated hole 82*b*, and upward movement of the first lower pressing roller 72 is also regulated by the first lower pressing roller shaft elongated hole 82*b*. Thus, as illustrated in detail in FIG. 7, an interval L1 between the first upper pressing roller and the first lower pressing roller 72 is always kept constant. In the present embodiment, the interval L1 is set to about 14 mm. Further, the first upper pressing roller pressing spring 91*a* and the first lower pressing roller pressing spring 91*b* are set so as to apply a load of 4.0 kg to the first upper and lower pressing rollers 71 and 72 in a state where the rollers 71 and 72 are brought into contact with each other.

As can be seen well from FIGS. 6 and 7, the pressing roller pair 70 of a second row has the same configuration as that of the pressing roller pair 70 of the first row.

That is, the pressing rollers 70 of the second row includes a second upper pressing roller 73 and a second lower pressing roller 74 which are disposed opposite to each other and spaced apart from each other by a predetermined interval. The second upper and lower pressing rollers 73 and 74 have a second upper pressing roller shaft 79*a* and a second lower pressing roller shaft 79*b*, respectively. The second upper and lower pressing roller shafts 79*a* and 79*b* are supported by a second upper pressing roller bracket 87*a* and a second lower pressing roller bracket 87*b*, respectively. The second upper pressing roller bracket 87*a* is vertically movably supported by the unit top plate 59*a*, and the second lower pressing roller bracket 87*b* is vertically movably supported by the unit bottom plate 59*b*.

Further, a second upper pressing roller pressing spring 92*a* is interposed between the second upper pressing roller bracket 87*a* and the unit top plate 59*a* so as to bias the second upper pressing roller bracket 87*a* and unit top plate 59*a* in a direction separating them from each other; similarly, a second lower pressing roller pressing spring 92*b* having the same function as the second upper pressing roller pressing spring 92*a* is interposed between the second lower pressing roller bracket 87*b* and the unit bottom plate 59*b*.

With this configuration, the second upper pressing roller 73 and the second lower pressing roller 74 are always biased in a direction approaching each other. On the other hand, a second upper pressing roller shaft elongated hole 83*a* is formed in the unit base plate 62*a* and the front upper base plate 62*b* that support the second upper pressing roller shaft 79*a*. Thus, the biasing force of the second upper pressing roller pressing spring 92*a* is regulated by the second upper pressing roller shaft elongated hole 83*a*, and downward movement of the second upper pressing roller 73 is also regulated by the second upper pressing roller shaft elongated hole 83*a*. Further, the biasing force of the second lower pressing roller pressing spring 92*b* is regulated by a second lower pressing roller shaft elongated hole 83*b*, and upward movement of the second lower pressing roller 74 is also regulated by the second lower pressing roller shaft elongated hole 83*b*. Thus, as illustrated in detail in FIG. 7, an interval L2 between the second upper pressing roller 73 and the second lower pressing roller 74 is always kept constant. In the present embodiment, the interval L2 is set to about 7 mm. Further, the second upper pressing roller pressing spring 92*a* and the second lower pressing roller pressing spring 92*b* are set so as to apply a load of 4.0 kg to the second upper and lower pressing rollers 73 and 74 in a state where the rollers 73 and 74 are brought into contact with each other.

Further, as can be seen well from FIGS. 6 and 7, the pressing roller pair 70 of a third row has the same configuration as those of the pressing roller pairs 70 of the respective first and second rows, so descriptions of the pressing roller pair 70 of the third row will be omitted here, and only a different point will be described. That is, the first upper and lower pressing rollers 71 and 72 of the first row are separated from each other by the predetermined interval L1 (in the present embodiment, 14.3 mm) as illustrated in FIG. 7; similarly, the second upper and lower pressing rollers 73 and 74 of the second row are separated from each other by the predetermined interval L2 (in the present embodiment, 7.2 mm). This is because the first upper pressing roller shaft elongated hole 82*a*, the first lower pressing roller shaft elongated hole 82*b*, the second upper pressing roller shaft elongated hole 83*a*, and the second lower pressing roller shaft elongated hole 83*b* serve as an interval regulating member. Thus, by the above elongated holes, the pair of the pressing rollers are position-regulated so as to prevent the interval therebetween from being made smaller than the predetermined interval.

On the other hand, third upper and lower pressing rollers 75 and 76 of the third row are always elastically biased so as to be brought into pressure contact with each other. That is, a third upper pressing roller shaft elongated hole 84*a* and a third lower pressing roller shaft elongated hole 84*b* are formed such that a roller interval L3 is 0. A third upper pressing roller pressing spring 93*a* and a third lower pressing roller pressing spring 93*b* are set so as to apply a load of 4.0 kg to the third upper and lower pressing rollers 75 and 76 at the roller contact position. With this configuration, the sheet pressing is performed while a load exceeding 4 kg is applied to both sides of the fold of the folded sheet bundle BS.

As described above, the pressing rollers 70 as a sheet pressing member of the present invention include the first, second, and third upper pressing rollers 71, 73, and 75 and the first, second, and third lower pressing rollers 72, 74, and 76 which are disposed opposite respectively to the upper pressing rollers 71, 73, 75. The above pressing rollers 70 of a plurality of rows (in the present embodiment, three rows) are unitized as the pressing roller unit 56 and configured to be movable. Further, the above pressing rollers 70 can be rotated in the moving direction thereof. The pressing roller unit 56 is moved along the fold (in the sheet width direction) with the first upper and lower pressing rollers 71 and 72 of the first row, the interval between which is largest, in front. The interval between the second upper and lower pressing rollers 73 and 74 of the last row but one (in the present embodiment, second row) is made smaller. The third upper and lower pressing rollers 75 and 76 of the third row (last row in the moving direction) are configured to press the folded sheet bundle from both sides with a spring force of 4 kg. That is, in the present embodiment, the intervals between the pressing rollers of the respective rows are reduced stepwise from the first row to the last row. With this configuration, the pressing rollers of three rows arranged and supported in one unit are moved along the fold of the folded sheet bundle BS while pressing the folded sheet bundle BS from both sides. Further, the pressing rollers of each row are configured to press the folded sheet bundle BS from both sides with the pressing position set at a center of each roller pair.

[Operation of Sheet Pressing Device]

Hereinafter, carry-in of the folded sheet bundle BS to the sheet pressing device 50 and stepwise pressing operation will be described with reference to FIGS. 8 to 10.

Figure 8:
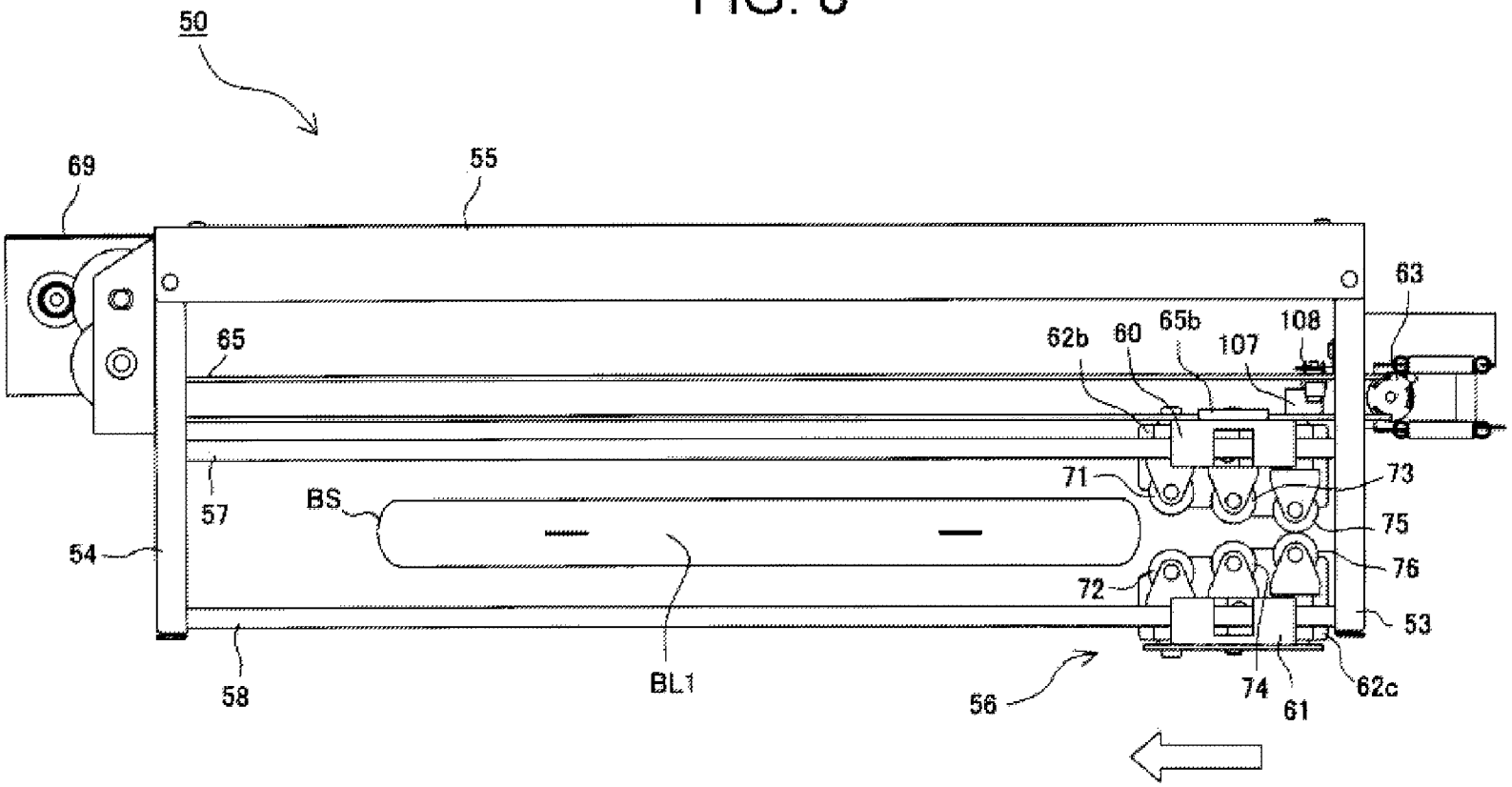
FIG. 8 is a front view illustrating a state where the pressing roller unit illustrated in FIGS. 4 to 7 is situated at a start position.

FIG. 8 illustrates a state where the pressing roller unit 56 is situated at the home position and waits for carry-in of the folded sheet bundle BS. FIG. 8 is a view as viewed from the bundle discharge roller 49 side, in which the unit base plate 62*a* is omitted for descriptive convenience.

In FIG. 8, the unit flag 107 of the pressing roller unit 56 having the pressing rollers 70 of three rows is detected by the home position sensor 108 attached to the right side plate 53, that is, the pressing roller unit 56 is situated at the home position. When the "folded sheet pressing mode" described above is set at this time, the pressing roller unit 56 waits for carry-in of the folded sheet bundle BS that is subjected to the folding by the folding roller 45 and conveyed along the folded sheet conveying path PB.

In the pressing roller unit 56 situated at the home position, the intervals between the pair of pressing rollers 70 of the respective rows are reduced from the first row in the moving direction toward the last row. That is, the pair of pressing rollers 70 of the last row are brought into pressure contact with each other. As described above, in the present embodiment, the first upper and lower pressing rollers 71 and 72 of the first row are disposed at an interval of about 14 mm, the second upper and lower pressing rollers 73 and 74 of the second row are disposed at an interval of about 7 mm, and the third upper and lower pressing rollers 75 and 76 of the third row are brought into pressure contact with each other. A center of the separation and pressure contact between the pair of pressing rollers is set so as to coincide with the folding loop leading end (fold) BL1 which is a center of the folded sheet bundle BS.

When the folding loop of the folded sheet bundle BS becomes a predetermined size (in the present embodiment, 22 mm in the vertical direction of the loop), the folding roller 45 is stopped, and the drive motor 69 is driven to move the pressing roller unit 56 to the left in FIG. 8. When this movement is started, the first upper and lower pressing rollers 71 and 72 of the first row override a right side (one end side) end portion (sheet end portion) of the folded sheet bundle BS and are moved to the left while creating a fold at a position slightly above the folding loop leading end BL1. As described above, the size of the loop in the present embodiment is about 22 mm, and the interval between the first upper and lower pressing rollers 71 and 72 is about 14 mm, so that the first upper and lower pressing rollers 71 and 72 overlap the upper and lower portions of the loop, respectively, each by a length of slightly less than about 4 mm to thereby creating a first fold. Further, since the first upper and lower pressing rollers 71 and 72 are disposed at a large interval, the pressing rollers 71 and 72 can override the end portion of the folded sheet bundle BS without significantly damaging the end portion. Further, the pressing rollers 70 including the first upper and lower pressing rollers 71 and 72 are axially rotatably supported in a direction crossing the moving direction, and this rotation makes it easy for the pressing rollers to ride over the end portion of the folded sheet bundle.

When the pressing roller unit 56 is further moved, the loop of the folded sheet bundle BS pressed between the first upper and lower pressing rollers 71 and 72 is further pressed between the second upper and lower pressing rollers 73 and 74, the interval between which is slightly smaller than the interval between the first upper and lower pressing rollers 71 and 72, whereby a second fold is created. In the present embodiment, the interval between the second upper and lower pressing rollers 73 and 74 is set to about 7 mm, so that the second upper and lower pressing rollers 73 and 74 overlap the respective upper and lower portions of the loop which has been pressed by the first upper and lower pressing rollers 71 and 72, each by a length of about 3.5 mm.

Successively, the folding loop leading end BL1 is pressed between the third upper and lower pressing rollers 75 and 76. That is, the third upper and lower pressing rollers 75 and 76 are brought into a substantially pressure contact state with the interval therebetween set to 0, so that they press the fold while being pressed by the third upper and lower pressing roller pressing springs 93*a* and 93*b* by an amount corresponding to a thickness of the sheet bundle at the fold.

Figure 9:
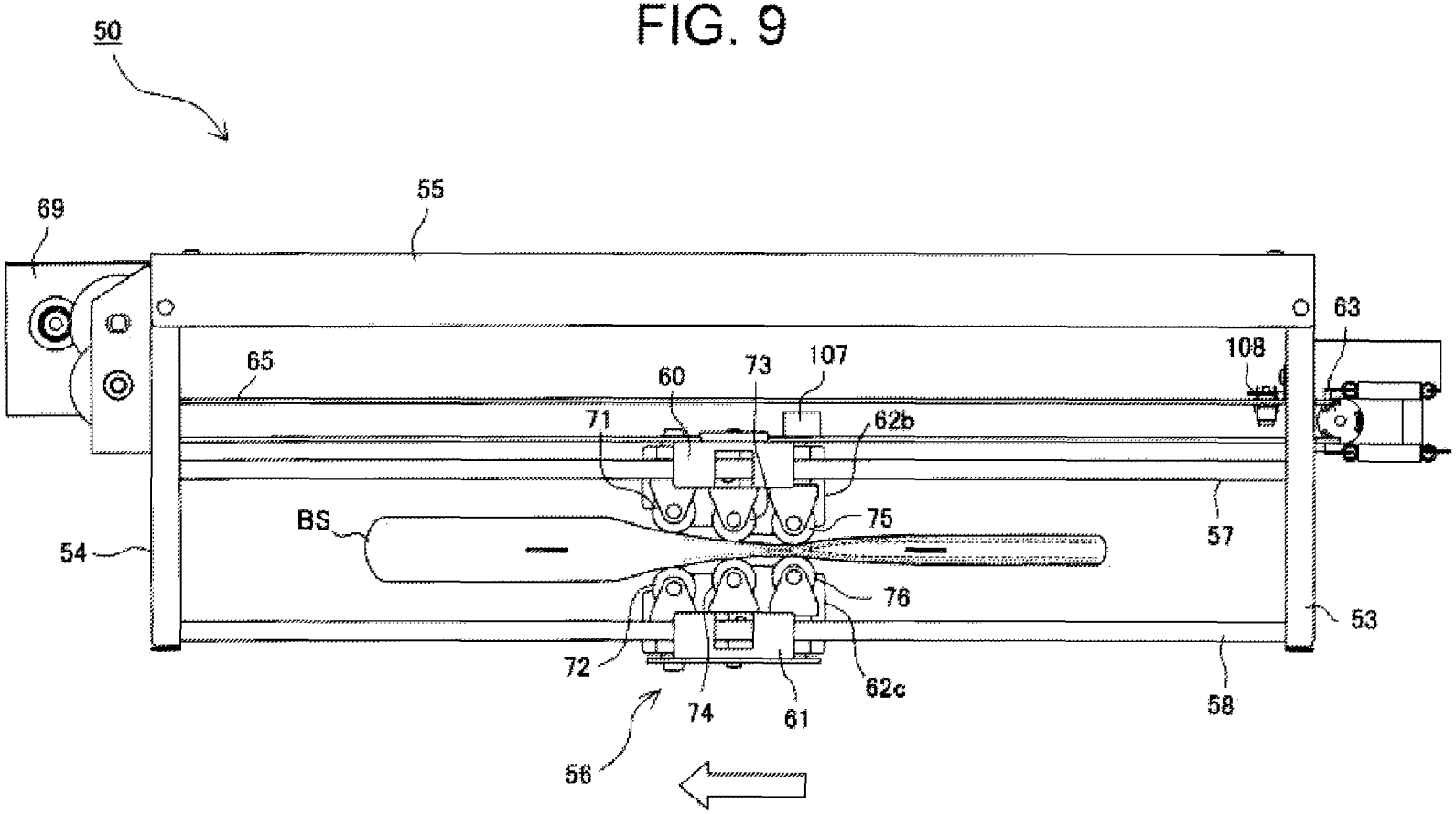
FIG. 9 is a front view illustrating a state where the pressing roller unit illustrated in FIGS. 4 to 7 is moved in the middle of the folded sheet bundle in a width direction thereof.

FIG. 9 illustrates a state where the pressing roller unit 56 pressing the folded sheet bundle BS stepwise is situated at a center of the folded sheet bundle BS in the sheet width direction. From this state, the pressing roller unit 56 is further moved to the left in FIG. 9 while pressing the fold of the sheet bundle BS. In this movement, the third upper and lower pressing rollers 75 and 76 of the third row pass through and press the right side (one end side) end portion (sheet end portion) of the folded sheet bundle BS. After passing through the folded sheet bundle BS, the pressing roller unit 56 reaches the returning position at the left side plate 54 side. This state is illustrated in FIG. 10. When the pressing roller unit 56 reaches the returning position, drive of the drive motor 69 is stopped. Thereafter, the pressing roller unit 56 waits for the pressed folded sheet bundle BS to be discharged by rotation of the folding roller 45 and the bundle discharge roller 49 in the discharge direction. When a state where the pressed folded sheet bundle BS is discharged is detected by a not illustrated sheet sensor, the pressing roller unit 56 is returned from the returning position to the home position (position illustrated in FIG. 8) and waits for carry-in of the next folded sheet bundle BS.

Figure 10:
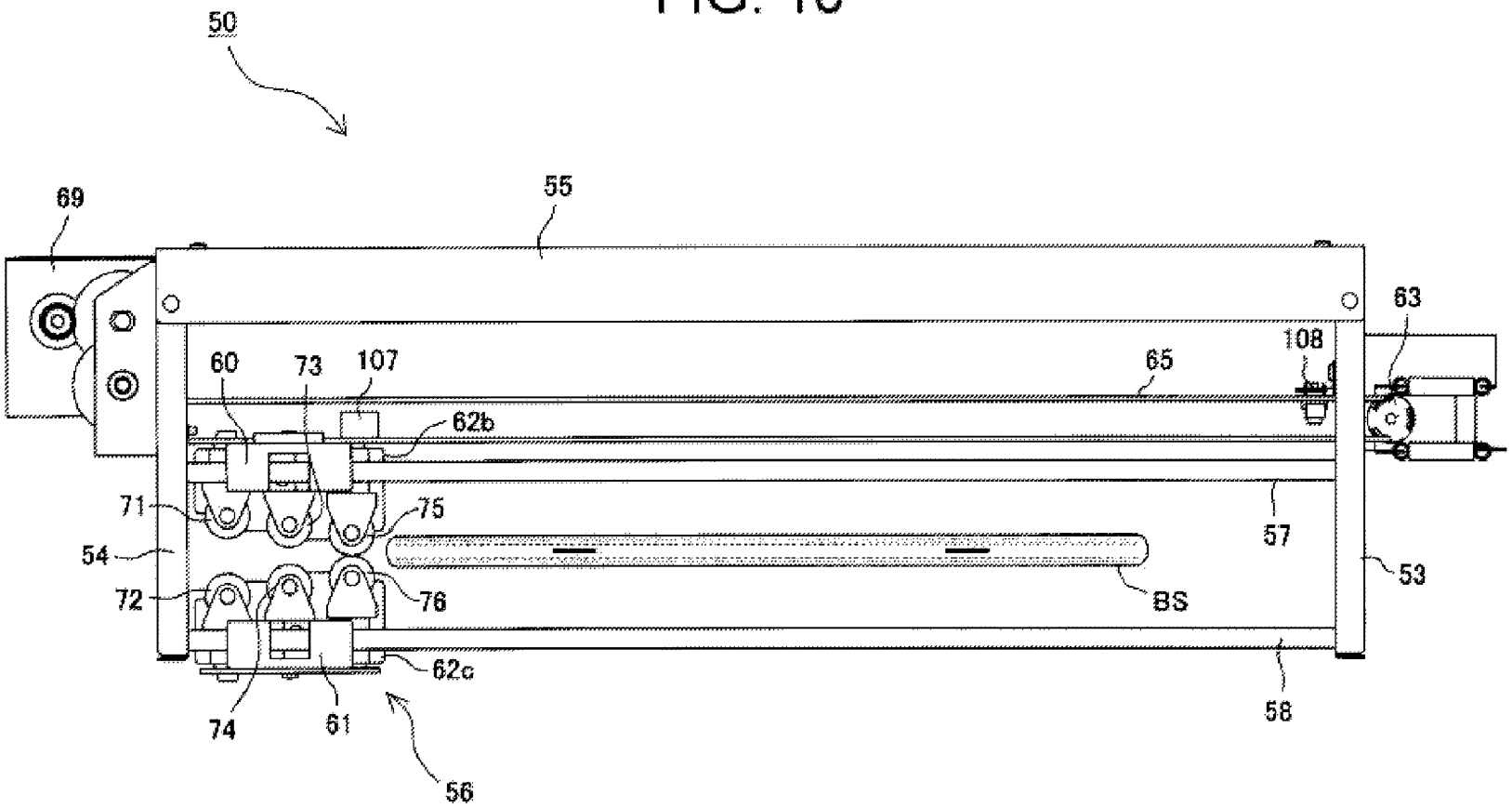
FIG. 10 is a front view illustrating a state where the pressing roller unit illustrated in FIGS. 4 to 7 is situated at an end position in the width direction.
Figure 11:
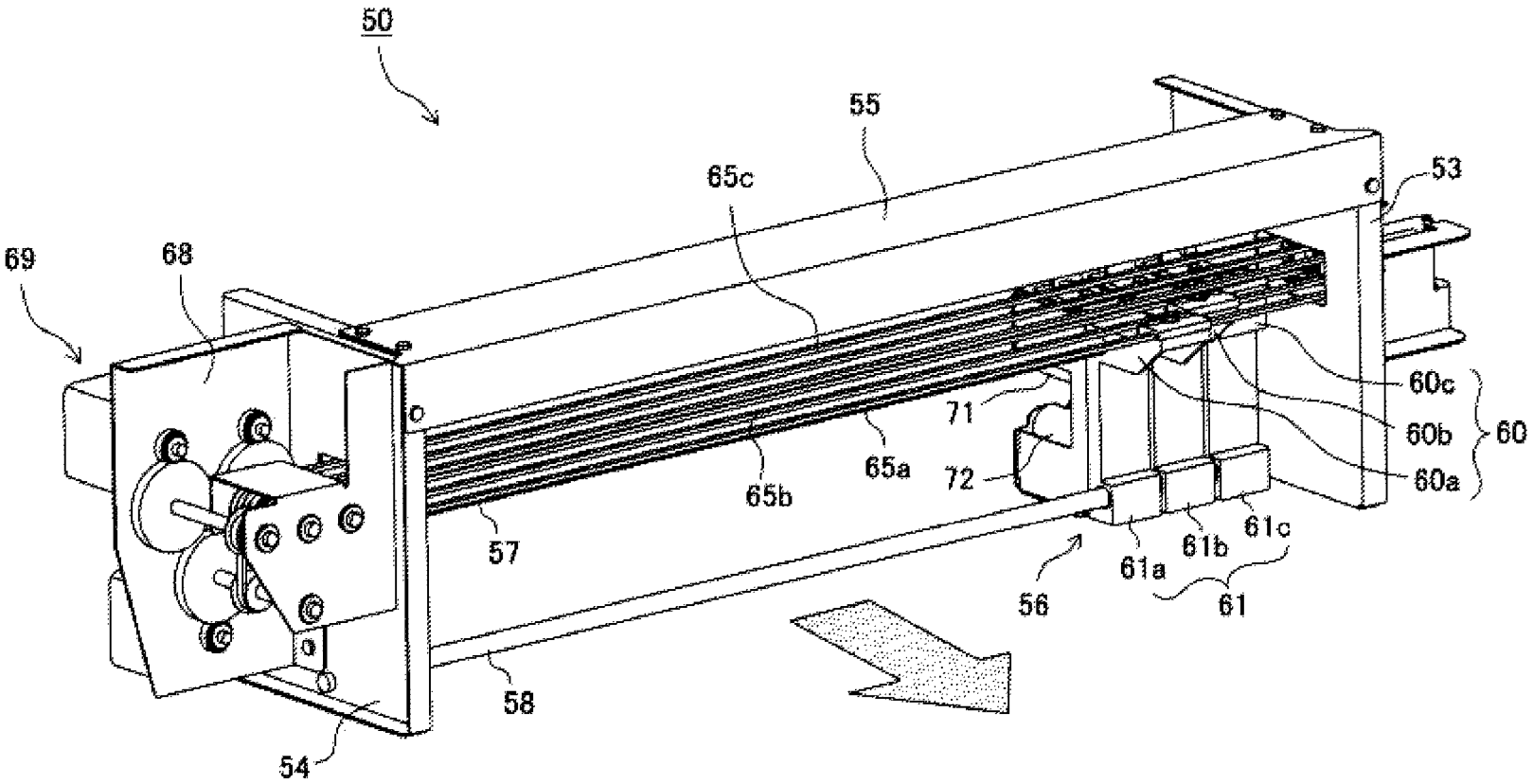
FIG. 11 is a perspective view of a sheet pressing device of a second embodiment as viewed from the side of the bundle discharge roller of FIG. 2.

In the above description, the pressing roller unit 56 is returned to the home position after the pressed folded sheet bundle BS of FIG. 10 is discharged; alternatively, however, the following configuration may be adopted. That is, before discharge of the folded sheet bundle BS, the pressing roller unit 56 is moved from the left to right of FIG. 10 toward the home position to press once again the fold of the folded sheet bundle BS between the third upper and lower pressing rollers 75 and 76, whereby pressing by the pressing rollers of the last row can surely be performed.

[Sheet Pressing Device of Second Embodiment]

The following describes a second embodiment different from the embodiment described above. The same reference numerals are given to the components having the same function and working effect as those of the components described in the above-described embodiment, and descriptions thereof will be omitted. The sheet pressing device of the second embodiment differs from that of the above-described embodiment in terms of a configuration of the pressing roller unit 56 incorporated in the sheet pressing device 50. That is, in the pressing roller unit 56 of the above embodiment, three rows of the pressing roller pairs 70 are arranged; on the other hand, in the second embodiment, the pressing roller unit 56 is provided for each row of the pressing roller pair 70. Hereinafter, based on the drawings, the second embodiment will be described.

As illustrated in FIGS. 11 to 15, the pressing roller unit of the second embodiment is divided into three units. That is, three rows of first to third pressing roller units 56*a*, 56*b*, and 56*c* are provided. The pressing roller units (56*a*, 56*b*, and 56*c*) configured to be reciprocated are slidably moved along the upper guide rail 57 and the lower guide rail 58 extending between the right side plate 53 and the left side plate 54. More specifically, a first upper slide block 60*a* of the first pressing roller unit 56*a*, a second upper slide block 60*b* of the second pressing roller unit 56*b*, and a third upper slide block 60*c* of the third pressing roller unit 56*c* are slidably attached to the upper guide rail 57. Further, a first lower slide block 61*a* of the first pressing roller unit 56*a*, a second lower slide block 61*b* of the second pressing roller unit 56*b*, and a third lower slide block 61*c* of the third pressing roller unit 56*c* are slidably attached to the lower guide rail 58.

Figure 12:
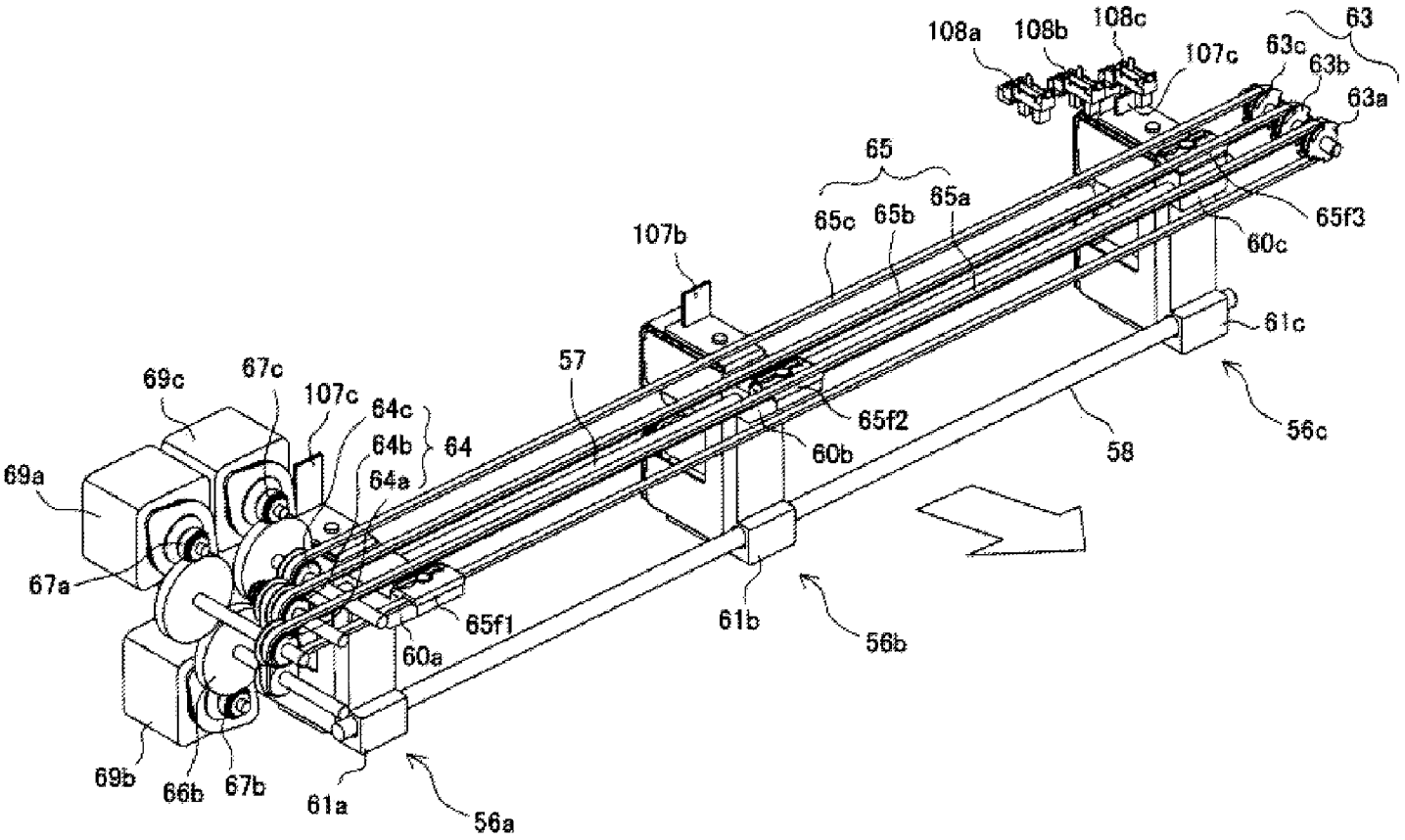
FIG. 12 is a perspective view illustrating a drive system of pressing roller units of the second embodiment of FIG. 11.
Figure 13:
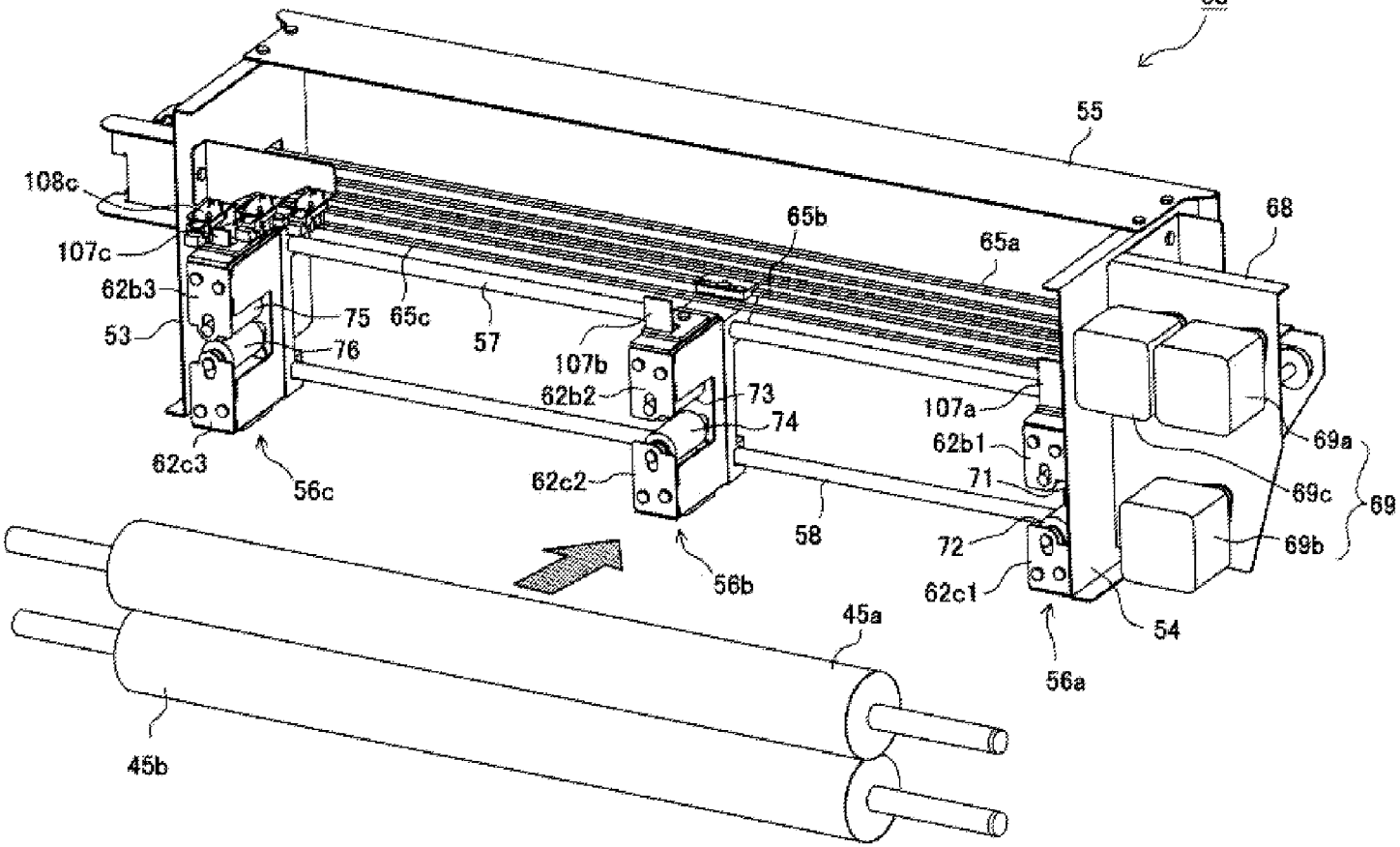
FIG. 13 is a perspective view of the sheet pressing device as viewed from the side of the folding roller of FIG. 2 in a state where one of the pressing roller units of the second embodiment is moved.

Further, as illustrated in FIG. 12, above the pressing roller units 56 and between the right side plate 53 and the left side plate 54 of the device, the moving belts 65 (moving belts 65*a*, 65*b*, and 65*c*) are stretched between the right pulleys 63 (pulleys 63*a*, 63*b*, and 63*c*) and left pulleys 64 (left pulleys 64*a*, 64*b*, and 64*c*). In order from the bundle discharge roller 49 side, the first pressing roller unit 56*a* is fixed to the first moving belt 65*a* through a first moving belt fixing portion 65*f*1, the second pressing roller unit 56*b* is fixed to the second moving belt 65*b* through a second moving belt fixing portion 65*f*2, and the third pressing roller unit 56*c* is fixed to the third moving belt 65*c* through a third moving belt fixing portion 65*f*3.

Thus, when the first moving belt 65*a* is moved to move the first belt fixing portion 65*f*1 from the device back side (right side) to device front side (left side), the first pressing roller unit 56*a* is moved from the device back side (right side) to device front side (left side) along the upper guide rail 57 and the lower guide rail 58. FIG. 12 illustrates a state where the first pressing roller unit 56*a* is situated at the returning position which is a position closest to the left side plate 54. When the first moving belt 65*a* is moved in the opposite direction, the first belt fixing portion 65*f*1 is also moved in the opposite direction, which moves the first pressing roller unit 56*a* in the opposite direction. In this regard, the second and third pressing roller units 56*b* and 56*c* have the same configuration.

The first left pulley 64*a* that winds the first moving belt 65*a* is mounted to the motor gear unit 68 provided on the left side plate 54 and connected to a drive motor 69*a* configured to be rotatable in normal and reverse directions through the motor gear unit 68. Rotation drive of the drive motor 69*a* is transmitted from a motor output gear 67*a* to a first transmission gear 66*a* provided in the motor gear unit 68, and then to the left pulley 64*a* of the first moving belt 65*a*.

The second left pulley 64*b* that winds the second moving belt 65*b* is mounted to the motor gear unit 68 provided on the left side plate 54 and connected to a drive motor 69*b* configured to be rotatable in normal and reverse directions through the motor gear unit 68. Rotation drive of the drive motor 69*b* is transmitted from a motor output gear 67*b* to a second transmission gear 66*b* provided in the motor gear unit 68, and then to the left pulley 64*b* of the second moving belt 65*b*.

Further, the third left pulley 64*c* that winds the third moving belt 65*c* is mounted to the motor gear unit 68 provided on the left side plate 54 and connected to a drive motor 69*c* configured to be rotatable in normal and reverse directions through the motor gear unit 68. Rotation drive of the drive motor 69*c* is transmitted from a motor output gear 67*c* to a third transmission gear 66*c* provided in the motor gear unit 68, and then to the left pulley 64*c* of the third moving belt 65*c*.

As described above, the driver motors 69 are configured to be able to move the moving belts 65 in a width direction of the folded sheet bundle.

Thus, selecting the rotating direction of the first drive motor 69*a* allows the first pressing roller unit 56*a* to be moved selectively in the directions from the device back side (right side) to the device front side (left side) and from the device front side (left side) to the device back side (right side). Also in this regard, the second and third pressing roller units 56*b* and 56*c* have the same configuration.

A unit flag 107*a* is provided near a right side plate side end portion on an upper surface of the first pressing roller unit 56*a*. The first unit flag 107*a* indicates that the first pressing roller unit 56*a* is situated at the home position near the right side plate 53. When the unit flag 107*a* is detected by a home position sensor 108*a*, it can be determined that the first pressing roller unit 56*a* is situated at the home position. When the first pressing roller unit 56*a* is moved to the left in the drawing from the home position, a position of the first pressing roller unit 56*a* is discriminated by a not illustrated pulse generator incorporated in the drive motor 69*a*, whereby it is determined that the first pressing roller unit 56*a* is situated at the returning position near the left side plate 54. Also this regard, the second and third pressing roller units 56*b* and 56*c* have the same configuration.

When the first pressing roller unit 56*a*, the second pressing roller unit 56*b*, and the third pressing roller unit 56*c* are situated at the returning position, the first drive motor 69*a*, the second drive motor 69*b*, and the third drive motor 69*c* are driven in this order to be rotated in the reverse direction to move the pressing roller units 56 toward the home position. Thus, the first pressing roller unit 56*a*, the second pressing roller unit 56*b*, and the third pressing roller unit 56*c* each serve as a moving member that is moved by means of the moving belts 65 and the like.

[Pressing Roller Unit of Second Embodiment]

Figure 14:
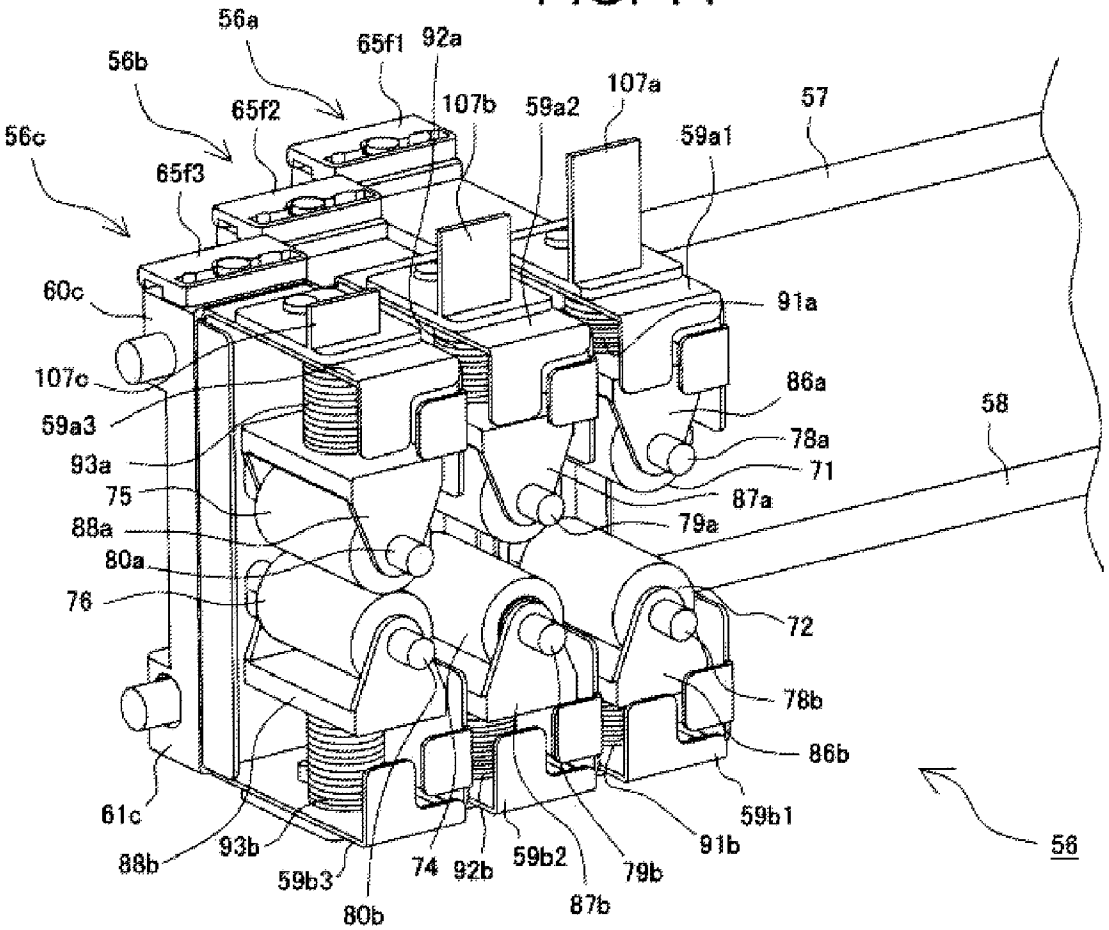
FIG. 14 is an enlarged view of the pressing roller units of the second embodiment as viewed from the side of the folding roller of FIG. 13.
Figure 15:
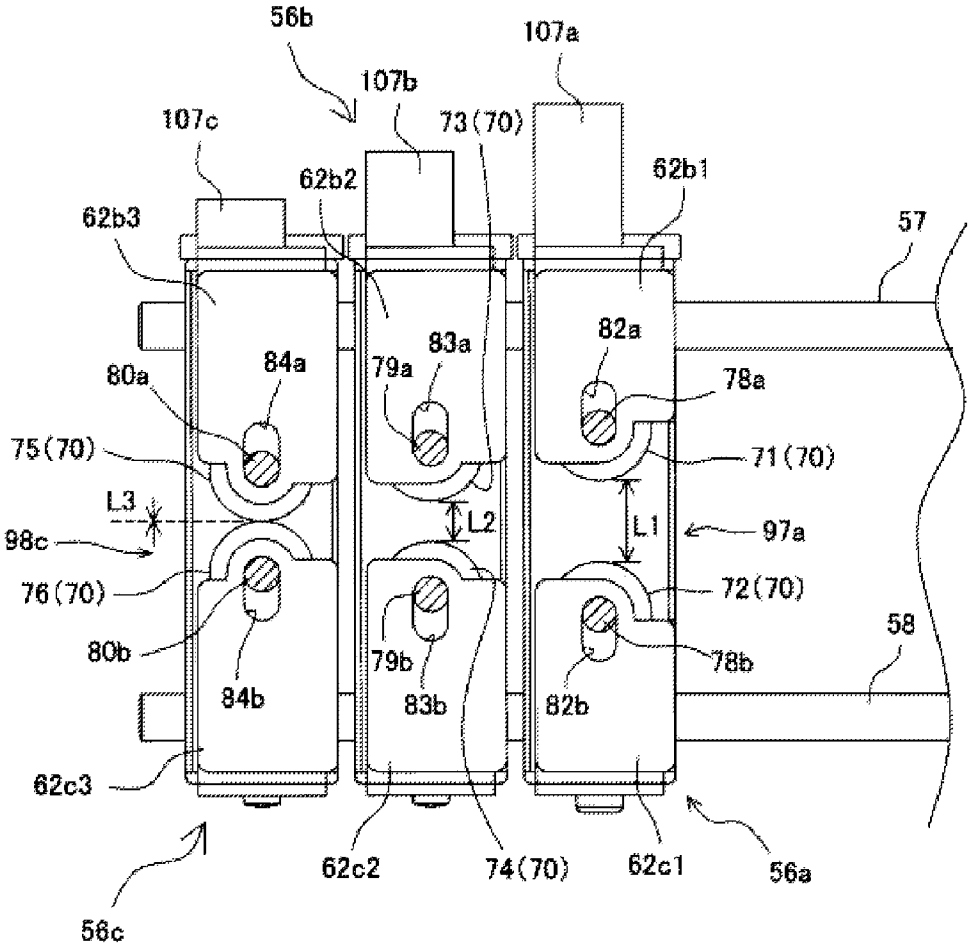
FIG. 15 is a front view of the pressing roller units of the second embodiment as viewed from the folding roller side.

The following describes the pressing roller units 56 configured to be moved to the left and right illustrated in FIGS. 14 and 15 which are views as viewed from the folding roller 45 side. As described above, the pressing roller according to the second embodiment is divided into a plurality of units, i.e., three rows of the first, second, and third pressing roller units 56*a*, 56*b*, and 56*c*. Since the three units 56*a*, 56*b*, and 56*c* have the same configuration except for an interval between the pair of pressing rollers supported therein, a configuration of the first pressing roller unit 56*a* will be described here as a representative example.

As illustrated in detail in FIG. 14, inside the first pressing roller unit 56*a*, the first upper pressing roller 71 and the first lower pressing roller 72 are disposed opposite to each other and spaced apart from each other by a predetermined interval. The first upper and lower pressing rollers 71 and 72 have the first upper pressing roller shaft 78*a* and the first lower pressing roller shaft 78*b*, respectively. The first upper and lower pressing roller shafts 78*a* and 78*b* are supported by the first upper pressing roller bracket 86*a* and the first lower pressing roller bracket 86*b*, respectively. The first upper pressing roller bracket 86*a* is vertically movably supported by a first unit top plate 59*a*1, and the first lower pressing roller bracket 86*b* is vertically movably supported by a first unit bottom plate 59*b*1.

Further, the first upper pressing roller pressing spring 91*a* is interposed between the first upper pressing roller bracket 86*a* and unit top plate 59*a*1 so as to bias the first upper pressing roller bracket 86*a* and the first unit top plate 59*a*1 in a direction separating them from each other; similarly, the first lower pressing roller pressing spring 91*b* having the same function as the first upper pressing roller pressing spring 91*a* is interposed between the first lower pressing roller bracket 86*b* and the first unit bottom plate 59*b*1. With this configuration, the first upper pressing roller 71 and the first lower pressing roller 72 are always elastically biased in a direction approaching each other.

On the other hand, a first upper pressing roller shaft elongated hole 82*a* is formed in a first unit base plate 62*a*1 (positioned on the back side in FIG. 15 and thus not visible) and a first front upper base plate 62*b*1 that support the first upper pressing roller shaft 78*a*. Thus, the biasing force of the first upper pressing roller pressing spring 91*a* is regulated by the first upper pressing roller shaft elongated hole 82*a*, and downward movement of the first upper pressing roller 71 is also regulated by the first upper pressing roller shaft elongated hole 82*a*. Further, the biasing force of the first lower pressing roller pressing spring 91*b* is regulated by the first lower pressing roller shaft elongated hole 82*b*, and upward movement of the first lower pressing roller 72 is also regulated by the first lower pressing roller shaft elongated hole 82*b*. Thus, as illustrated in FIG. 15, the interval L1 between the first upper pressing roller 71 and the first lower pressing roller 72 is always kept constant. In the present embodiment, the interval L1 is set to about 14 mm. Further, the first upper pressing roller pressing spring 91*a* and the first lower pressing roller pressing spring 91*b* are set so as to apply a load of 4.0 kg to the first upper and lower pressing rollers 71 and 72 in a state where the rollers 71 and 72 are brought into contact with each other.

As can be seen from FIGS. 14 and 15, the second pressing roller unit 56*b* of the second row has the same configuration as that of the first pressing roller unit 56*a* of the first row, and the interval L2 between the second upper pressing roller 73 and the second lower pressing roller 74 is always kept constant. In the present embodiment, the interval L2 is set to about 7 mm. Further, the second upper pressing roller pressing spring 92*a* and the second lower pressing roller pressing spring 92*b* are set so as to apply a load of 4.0 kg to the second upper and lower pressing rollers 73 and 74 in a state where the rollers 73 and 74 are brought into contact with each other.

Further, as can be seen well from FIGS. 14 and 15, the third pressing roller unit 56*c* of the third row has the same configuration as those of the first and second pressing roller units 56*a* and 56*b* of the respective first and second rows except for a point described below. That is, the first upper and second pressing rollers 71 and 72 of the first pressing roller unit 56*a* of the first row are separated from each other by the predetermined interval L1 (in the present embodiment, 14 mm) as illustrated in FIG. 15; similarly, the second upper and second pressing rollers 73 and 74 of the second pressing roller unit 56*b* of the second row are separated from each other by the predetermined interval L2 (in the present embodiment, 7 mm). On the other hand, a third upper pressing roller shaft elongated hole 84*a* and a third lower pressing roller shaft elongated hole 84*b* are formed such that the third upper and lower pressing rollers 75 and 76 of the third pressing roller unit 56*c* of the third row are always brought into pressure contact with each other (roller interval L3 is 0). The third upper pressing roller pressing spring 93*a* and the third lower pressing roller pressing spring 93*b* are set so as to apply a load of 4.0 kg to the third upper and lower pressing rollers 75 and 76 at the roller contact position. With this configuration, the sheet pressing is performed while a load equal to or more than 4 kg is applied to both sides of the fold of the folded sheet bundle BS.

[Operation of Pressing Roller Unit of Second Embodiment]

Hereinafter, carry-in of the folded sheet bundle BS to the sheet pressing device 50 and stepwise pressing operation will be described with reference to FIGS. 16 to 20.

Figure 16:
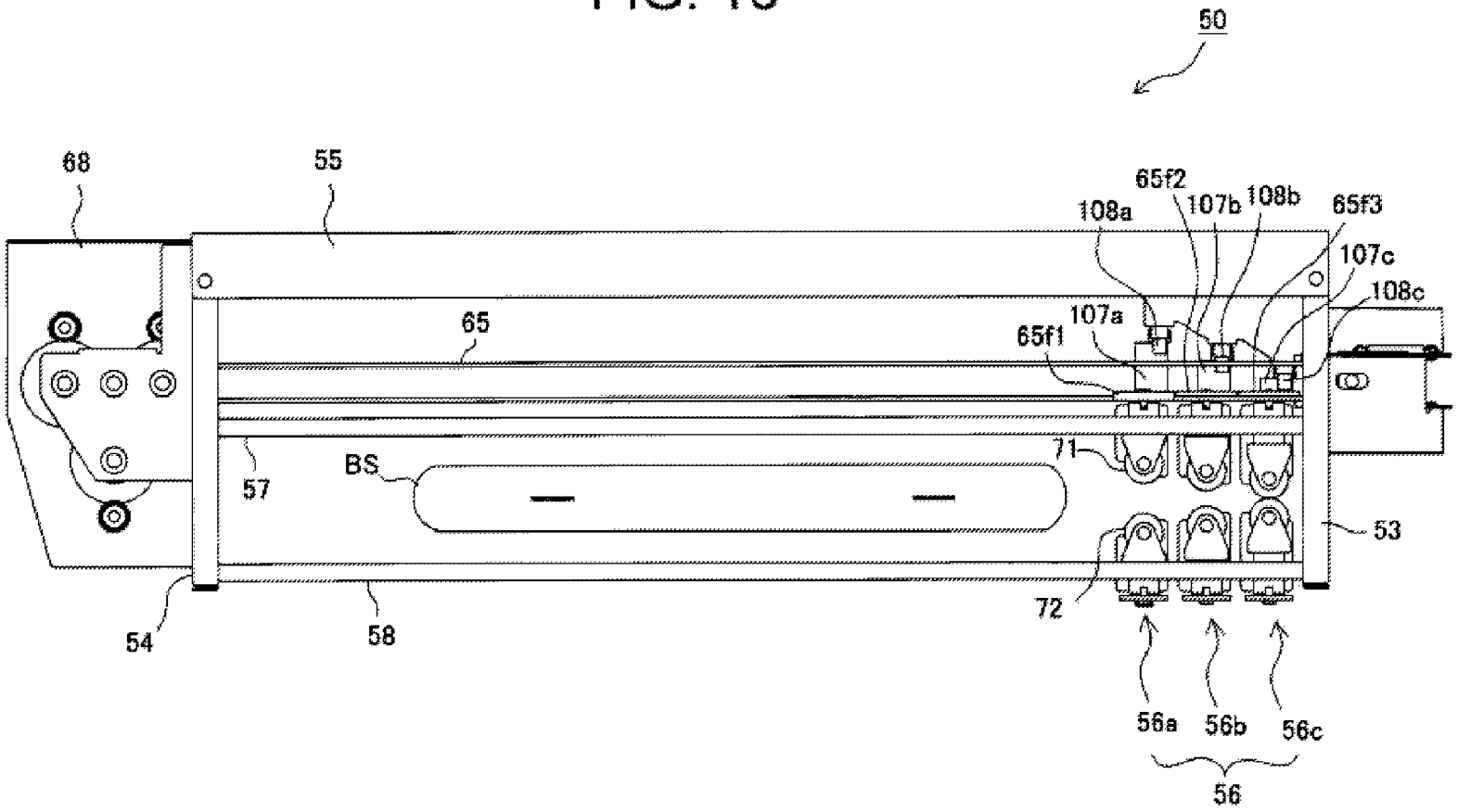
FIG. 16 is a front view illustrating a state where the pressing roller units of the second embodiment illustrated in FIGS. 14 and 15 are situated at a start position.

FIG. 16 illustrates a state where the first to third pressing roller units 56*a*, 56*b*, and 56*c* are situated at the illustrated home position and wait for carry-in of the folded sheet bundle BS. FIG. 16 is a view as viewed from the bundle discharge roller 49 side, in which the unit base plates 62*a* are omitted for descriptive convenience.

In FIG. 16, the first unit flag 107*a* of the first pressing roller unit 56*a* is detected by the first home position sensor 108*a* attached to the connecting angle, the second unit flag 107*b* of the second pressing roller unit 56*b* is detected by the second home position sensor 108*b*, and the third unit flag 107*c* of the third pressing roller unit 56*c* is detected by the third home position sensor 108*c*. That is, the pressing roller units 56 are situated at the home position and wait for carry-in of the folded sheet bundle BS.

When the "folded sheet pressing mode" described above is set at this time, the pressing roller units 56 wait for carry-in of the folded sheet bundle BS that is subjected to the folding by the folding roller 45 and conveyed along the folded sheet conveying path PB.

The intervals between the pair of pressing rollers 70 of the respective rows supported in the pressing roller units 56 situated at the home position are reduced from the first row in the moving direction toward the last row. That is, the pair of pressing rollers 70 of the last row are brought into pressure contact with each other. As described above, in the present embodiment, the first upper and lower pressing rollers 71 and 72 supported in the first pressing roller unit 56*a* of the first row are disposed at an interval of about 14 mm, the second upper and lower pressing rollers 73 and 74 supported in the second pressing roller unit 56*b* of the second row are disposed at an interval of about 7 mm, and the third upper and lower pressing rollers 75 and 76 supported in the third pressing roller unit 56*c* of the third row are brought into pressure contact with each other. A center of the separation and pressure contact between the pair of pressing rollers is set so as to coincide with the folding loop leading end (fold) BL1 which is a center of the folded sheet bundle BS.

Figure 17:
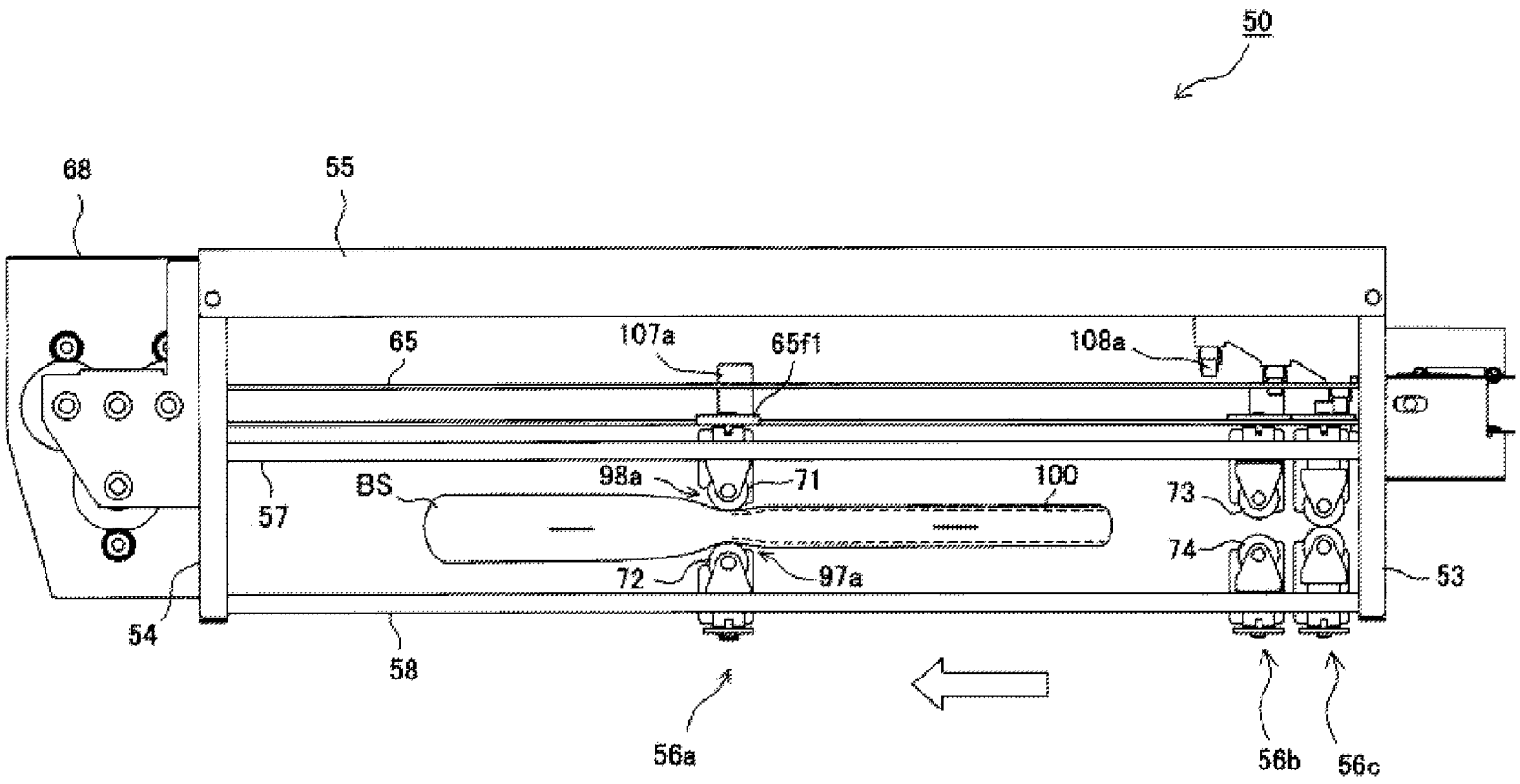
FIG. 17 is a front view illustrating a state where a first pressing roller unit of the second embodiment illustrated in FIGS. 14 and 15 is moved in the middle of the folded sheet bundle in the width direction thereof.

In FIG. 17, when the folding loop of the folded sheet bundle BS becomes a predetermined size (in the present embodiment, 22 mm in the vertical direction of the loop) as illustrated in FIG. 3D, the folding roller 45 is stopped, and the first drive motor 69*a* is driven to move the first pressing roller unit 56*a* to the left in FIG. 17. When this movement is started, the first upper and lower pressing rollers 71 and 72 supported in the first pressing roller unit 56*a* of the first row override a right side end portion of the folded sheet bundle BS and are moved to the left while creating a fold at a position slightly above the folding loop leading end BL1. As described above, the size of the loop in the present embodiment is about 22 mm, and the interval between the first upper and lower pressing rollers 71 and 72 is about 14 mm, so that the first upper and lower pressing rollers 71 and 72 overlap the upper and lower portions of the loop, respectively, each by a length of about 4 mm to thereby creating a first fold. Further, since the first upper and lower pressing rollers 71 and 72 are disposed at a large interval, the pressing rollers 71 and 72 can override the end portion of the folded sheet bundle BS without significantly damaging the end portion. Further, the pressing rollers 70 including the first upper and lower pressing rollers 71 and 72 are axially rotatably supported in a direction crossing the moving direction, and this rotation makes it easy for the pressing rollers to ride over the end portion of the folded sheet bundle.

Figure 18:
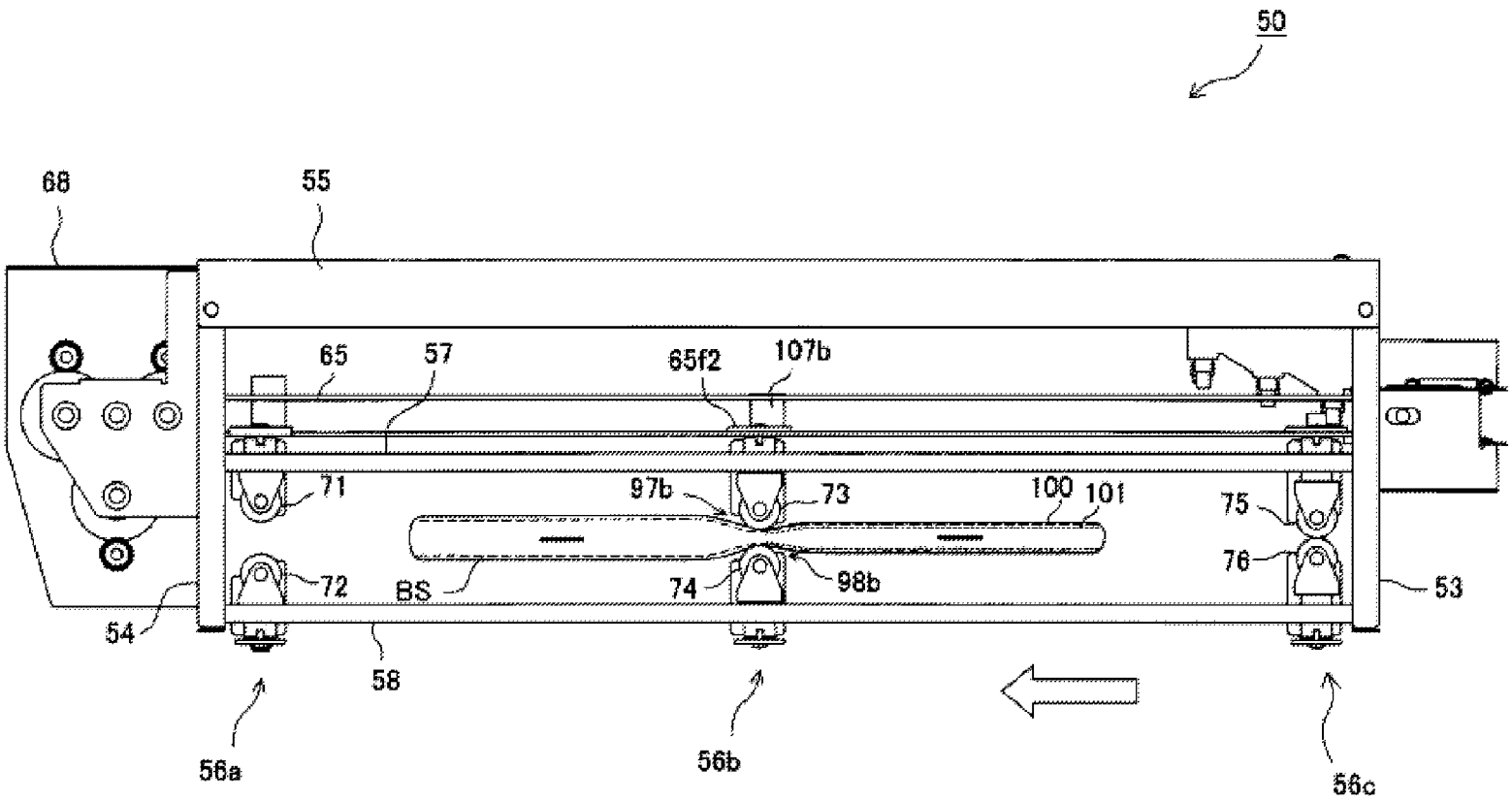
FIG. 18 is a front view illustrating a state where a second pressing roller unit of the second embodiment illustrated in FIGS. 14 and 15 is moved in the middle of the folded sheet bundle in the width direction thereof.

After being further moved, the first pressing roller unit 56*a* is stopped at the returning position at the left end as illustrated in FIG. 18. Simultaneously, the second pressing roller unit 56*b* is moved. FIG. 18 is a view illustrating a state where the second pressing roller unit 56*b* is situated at about a center of the folded sheet bundle BS. Thus, the loop pressed between the first upper and lower pressing rollers 71 and 72 of the first pressing roller unit 56*a* is further pressed between the second upper and lower pressing rollers 73 and 74, the interval between which is slightly smaller than the interval between the first upper and lower pressing rollers 71 and 72, whereby a second fold is created. In the present embodiment, the interval between the second upper and lower pressing rollers 73 and 74 is set to about 7 mm, so that the second upper and lower pressing rollers 73 and 74 overlap the respective upper and lower portions of the loop which has been pressed by the first upper and lower pressing rollers 71 and 72, each by a length of about 3.5 mm.

Figure 19:
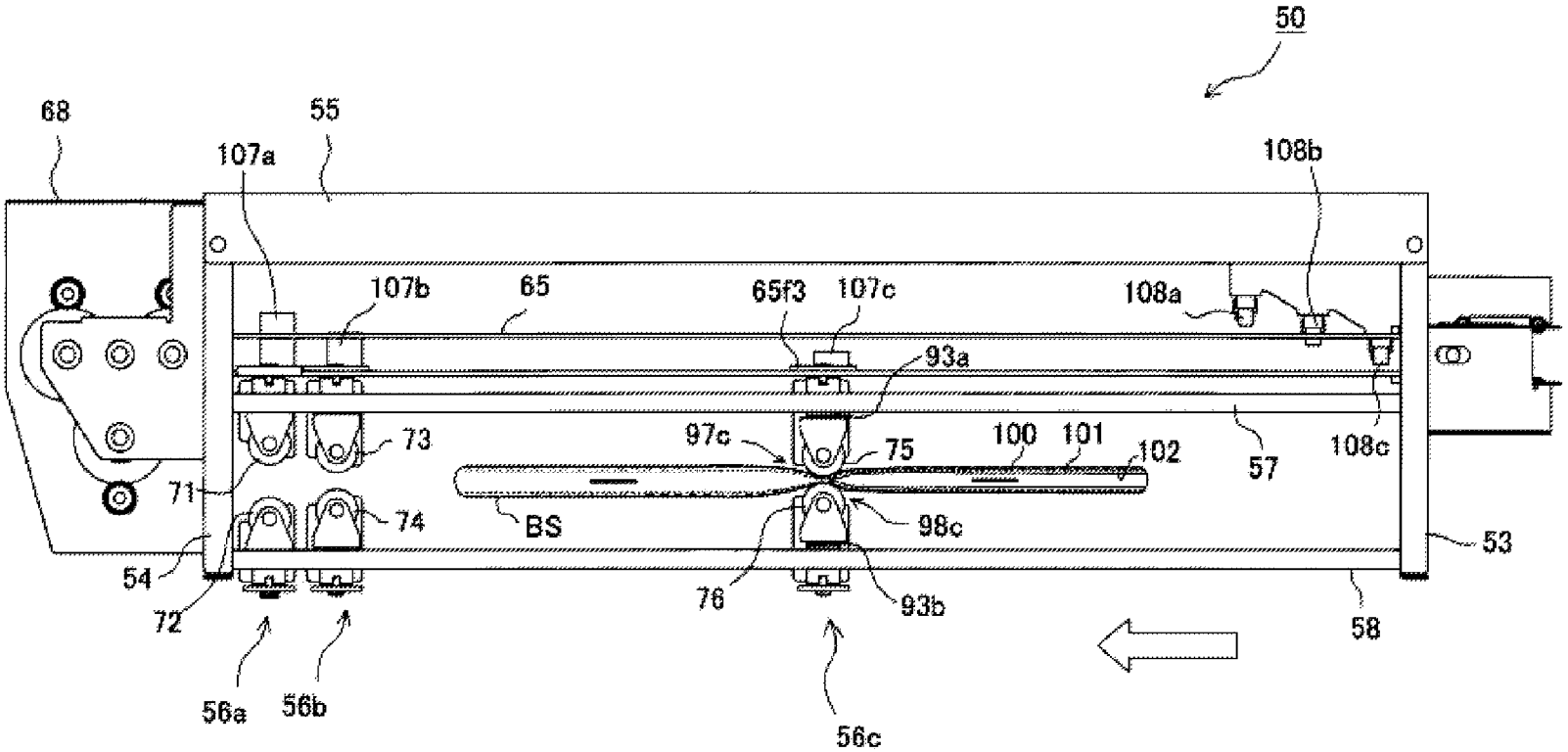
FIG. 19 is a front view illustrating a state where a third pressing roller unit of the second embodiment illustrated in FIGS. 14 and 15 is moved in the middle of the folded sheet bundle in the width direction thereof.

FIG. 19 illustrates a state where the second pressing roller unit 56*b* of the second row and the third pressing roller unit 56*c* of the third row are situated at the returning position and about a center of the folded sheet bundle BS in the width direction thereof, respectively. The folding loop leading end BL1 is pressed between the third upper and lower pressing rollers 75 and 76 supported in the third pressing roller unit 56*c*. That is, the third upper and lower pressing rollers 75 and 76 are brought into a substantially pressure contact state with the interval therebetween set to 0, so that they press the fold while being pressed by the third upper and lower pressing roller pressing springs 93*a* and 93*b* by an amount corresponding to a thickness of the sheet bundle at the fold.

Figure 20:
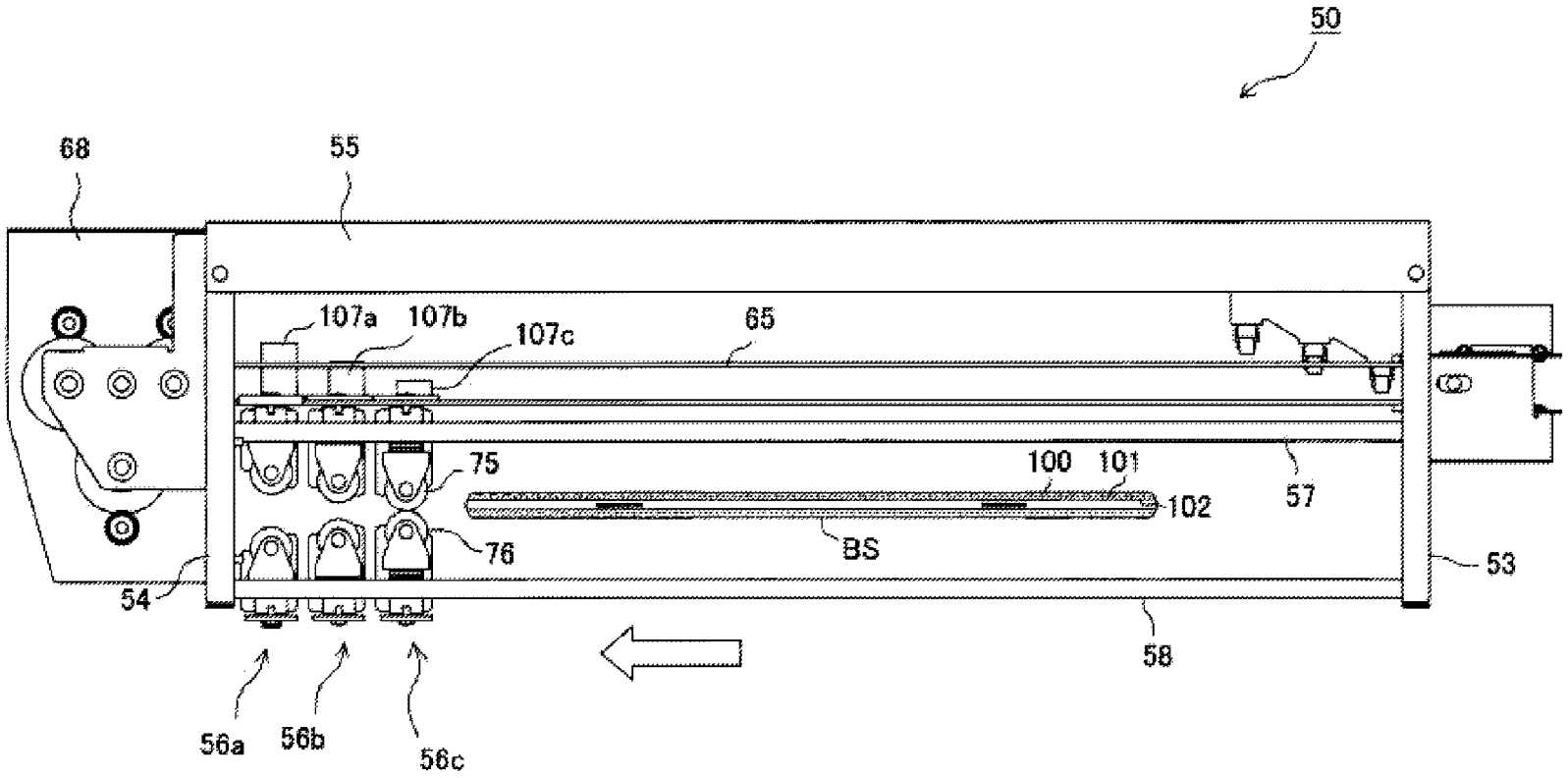
FIG. 20 is a front view illustrating a state where the pressing roller units of the second embodiment illustrated in FIGS. 14 and 15 are situated at an end position in the width direction.

As described above, the folded sheet bundle BS is pressed stepwise sequentially by the moving three units. Then, as illustrated in FIG. 20, the first to third pressing roller units 56*a* to 56*c* are situated at the returning position and wait for the pressed folded sheet bundle BS to be discharged by rotation of the folding roller 45 and the bundle discharge roller 49 in the discharge direction. In this state, the sheet end portion (left side end portion: other side end portion) in the width direction is situated at a position separated from the third pressing roller unit 56*c* that is moved last. Then, when a state where the pressed folded sheet bundle BS is discharged is detected by a not illustrated sheet sensor, the third pressing roller unit 56*c*, the second pressing roller unit 56*b*, and the first pressing roller unit 56*a* are returned in this order from the returning position to the home position and they wait for carry-in of the next folded sheet bundle BS at the position illustrated in FIG. 16.

In the above description, the third pressing roller unit 56*c*, the second pressing roller unit 56*b*, and the first pressing roller unit 56*a* are returned in this order from the returning position to the home position after the pressed folded sheet bundle BS of FIG. 20 is discharged; alternatively, however, the following configuration may be adopted. That is, before discharge of the folded sheet bundle BS, the third pressing roller unit 56*c* is moved from the left to right of FIG. 20 toward the home position to press once again the fold of the folded sheet bundle BS between the third upper and lower pressing rollers 75 and 76, and thereafter, the folded sheet bundle is discharged. As a result, pressing operation by the pressing roller unit of the last row is performed two times, whereby the pressing of the fold of the sheet bundle BS can surely be performed.

Further, the first to third pressing roller units 56*a* to 56*c* may be moved successively in the sheet fold direction without a space therebetween. In the manner as described above, in the present embodiment, three-step pressing operation is executed using the three units of the first to third pressing roller units 56*a* to 56*c*.

As described above, in the embodiments of the present invention including the second embodiment, the pressing roller unit 56 (or pressing roller units 56) is used to perform the three-step pressing operation for the folded sheet bundle BS. The following describes the folded sheet bundle BS in a state after being pressed and discharged with reference to FIGS. 21 and 22.

Figure 21A:
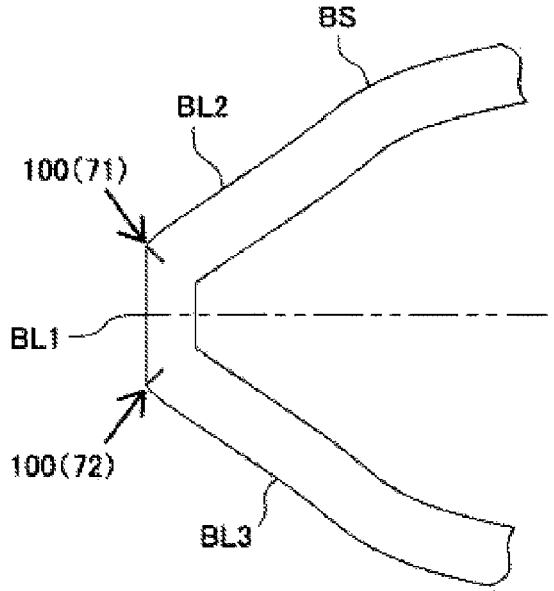
Figure 22:
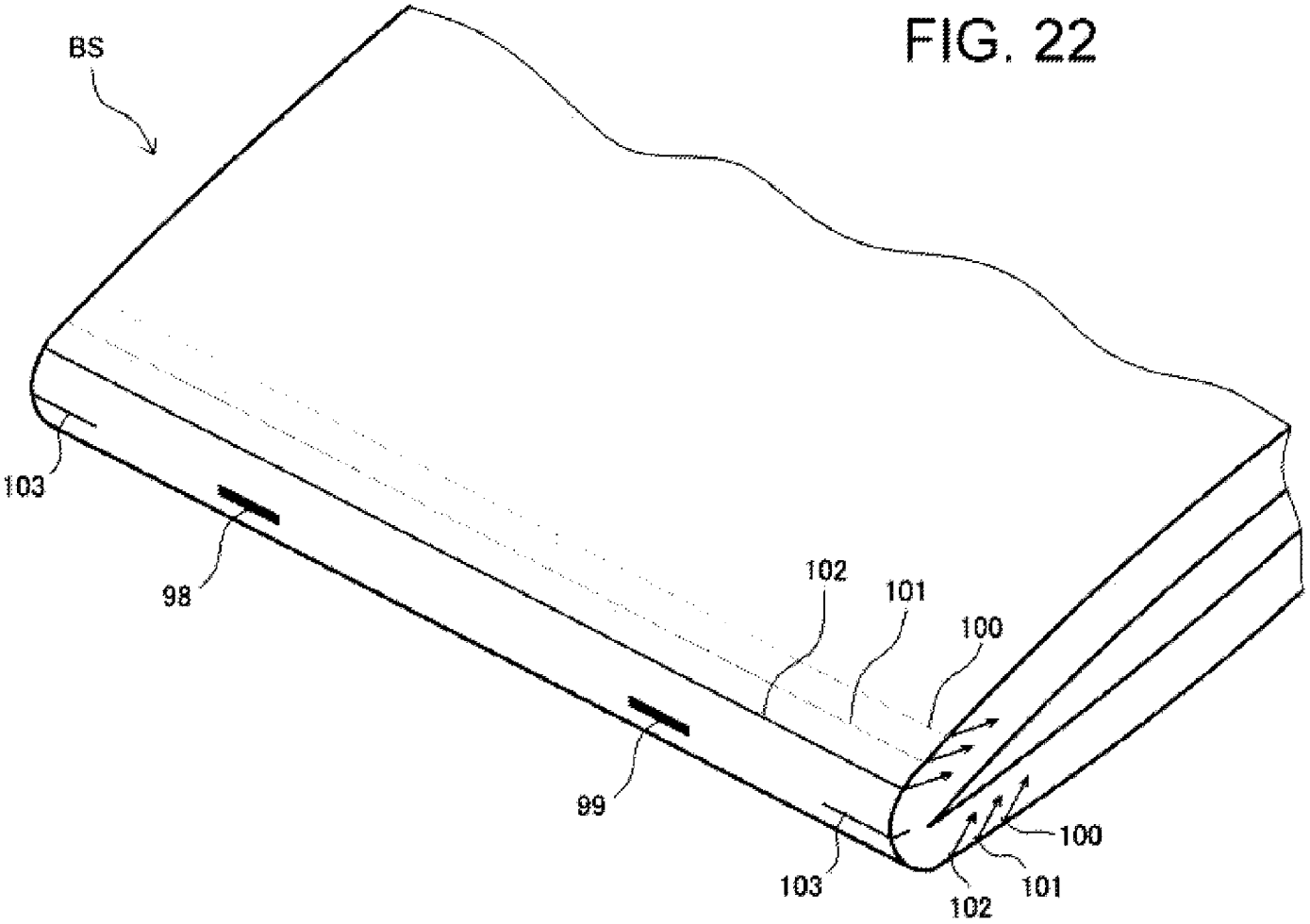
FIG. 22 is a folded sheet bundle in a finished state where the plurality of fold lines are formed therein as a result of pressing performed by the pressing roller unit of FIGS. 8 to 10 or pressing roller units of FIGS. 16 to 20 of the second embodiment.

As described hereinbefore, the first upper and lower pressing rollers 71 and 72 as the sheet bundle pressing member of the present invention are moved, along the fold direction, on a part of the folded sheet bundle BS where the fold is created by the folding roller 45 and thus the loop is generated while pressing the folded sheet bundle BS in a thickness direction (vertical direction crossing, at the fold of the folded sheet bundle BS, a conveying direction of the folded sheet bundle BS) of the fold to thereby create a plurality of folds. As described above, the interval between the first upper and lower pressing rollers 71 and 72 of the first step is set to a value (in the present embodiments, about 14 mm relative to the loop size (height) of 22 mm) slightly smaller than the loop size, and the first upper and lower pressing rollers 71 and 72 are moved along the fold created by the folding roller 45 to thereby create the first fold. The first fold is illustrated as a first fold line 100 indicated by a solid arrow in FIG. 21A. In FIG. 22, this first fold line 100 is represented by a light line on the folded sheet bundle BS. That is, as illustrated in FIG. 21A, a part of the loop that is pressed by the first upper and lower pressing rollers 71 and 72 is applied with a concentrated load, causing buckling in the sheet bundle to generate the fold. Then, by the movement of the first upper and lower pressing rollers 71 and 72 in the width direction, the buckled part appears as the first fold line 100.

Figure 21B:
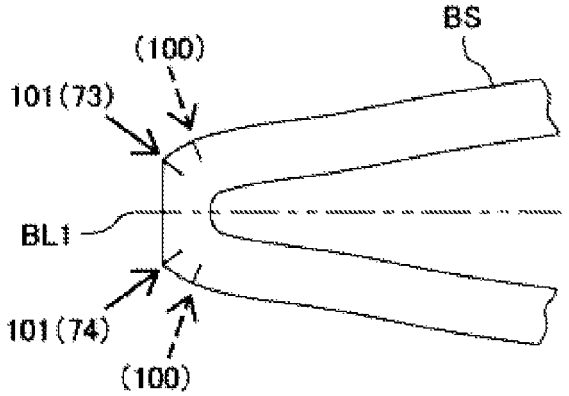
Figure 21C:
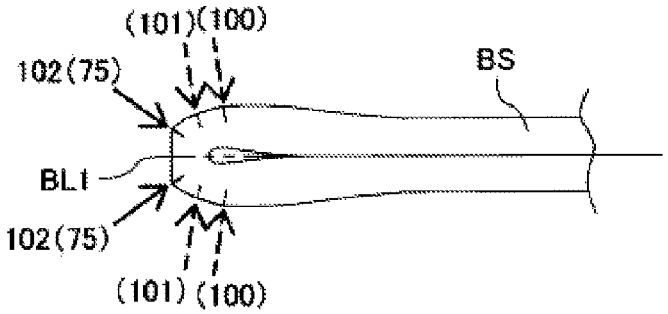

In the second step, the second upper and lower pressing rollers 73 and 74 as the sheet bundle pressing member, the interval between which is set to a value (in the present embodiments, about 7 mm) slightly smaller than the size of the loop pressed in the first step, and the second upper and lower pressing rollers 73 and 74 are moved along the fold created by the folding roller 45 to thereby create the second fold. The second fold is illustrated as a second fold line 101 positioned on a back side of the first fold line 100 and indicated by a slid arrow in FIG. 21B. In FIG. 22, this second fold line 101 is represented by a light line on the folded sheet bundle BS. That is, as illustrated in FIG. 21B, a part of the loop that is pressed by the second upper and lower pressing rollers 73 and 74 is applied with a concentrated load, causing buckling in the sheet bundle to generate the fold. Then, by the movement of the second upper and lower pressing rollers 73 and 74 in the width direction, the buckled part appears as the second fold line 101.

The third upper and lower pressing rollers 75 and 76 as the sheet bundle pressing member of the final step are brought into pressure contact with each other by the elastic force of the third upper and lower pressing roller pressing springs 93*a* and 93*b*. In the final step, unlike the first and second steps, no interval is provided between the third upper and lower pressing rollers 75 and 76 (in the present embodiments, interval is set to 0). Thus, in the final step, the third upper and lower pressing rollers 75 and 76 are moved along the fold while pressing the position corresponding to the thickness of the folded sheet bundle BS that has been pressed in the first and second steps. The fold created by the pressing rollers 70 of the final step is illustrated as a final fold line 102 indicated by a solid arrow in FIG. 21C. In FIG. 22, this final fold line 102 is represented by a comparatively dark line on the folded sheet bundle BS. At end portions of the folded sheet bundle BS in the width direction, end portion folds 103 created when the folding roller 45 and the pressing rollers 70, which are brought into a pressure contact state, override the folded sheet bundle BS are formed. A part that is pressed between the third upper and lower pressing rollers 75 and 76, which are brought into a substantially pressure contact state, appears as an enhanced fold, i.e., the final fold line 102.

As described above, the pressing roller pairs 70 having different intervals among the rows are used to buckle the folded sheet bundle BS to create the folds. As a result, a folding direction is directed to a closing direction (line extending in the conveying direction that passes the fold) of the folded sheet bundle BS at the respective positions of the first fold line 100 (indicated by the light line) of the first step, the second fold line 101 (indicated by the light line) of the second step, and the final fold line 102 (indicated by the comparatively dark line) of the final step generated in accordance with the thickness of the folded sheet bundle BS. With this configuration, it is possible to prevent the folded sheet bundle BS from being opened to thereby prevent degradation of aligning property and accumulating property.

[Control Configuration]

Figure 23:
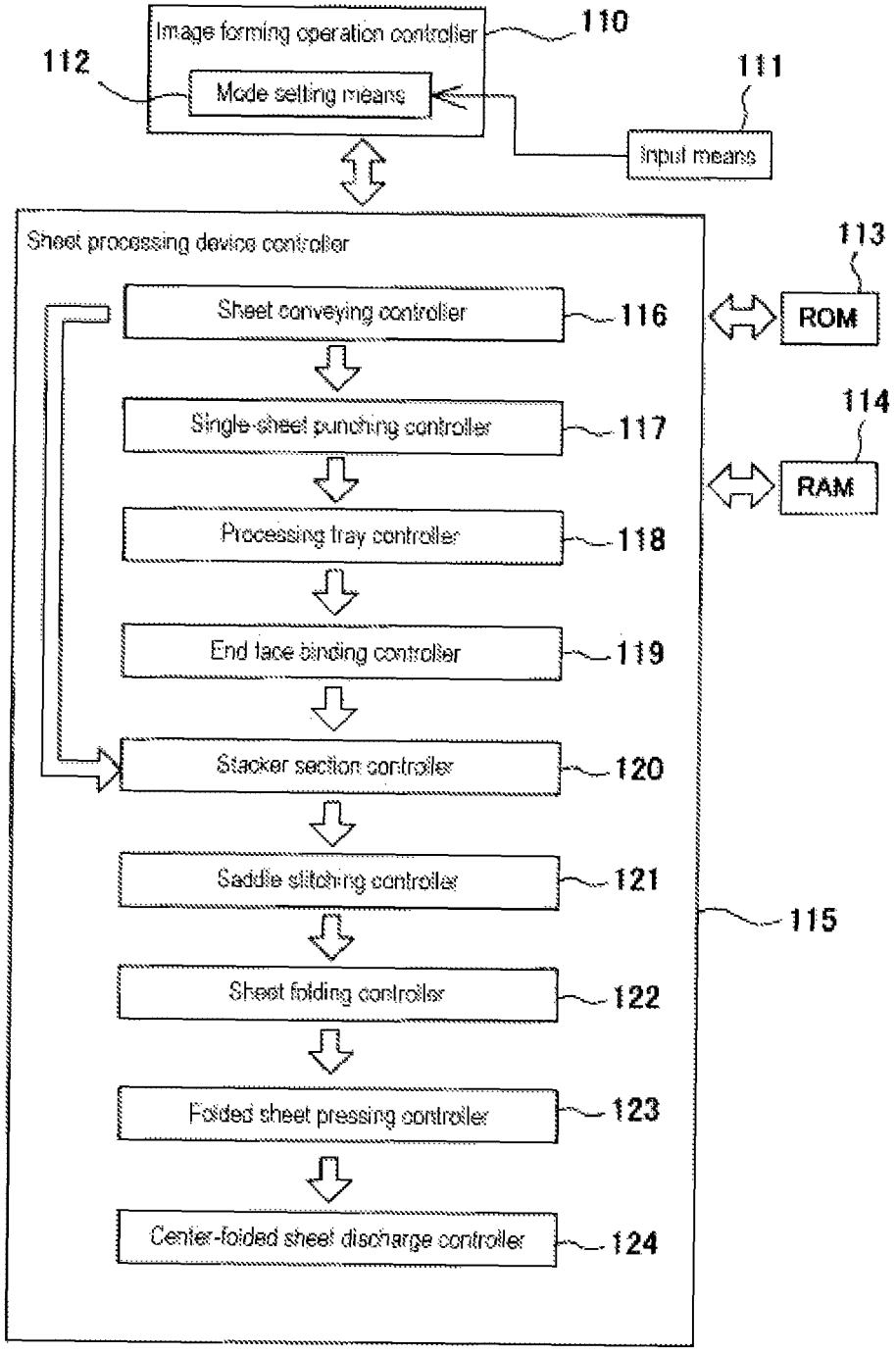
FIG. 23 is an explanatory view of a control configuration of the sheet processing device of FIG. 2.

Control configuration of the sheet processing device B provided with the thus described sheet pressing device 50 and the image forming device A including the sheet processing device B will be described based on a block diagram of FIG. 23. An image forming device controller 110 having an image forming means inputs desired processing through user's operation made to an input means provided on a control panel. This input controls a sheet processing device controller 115 of the sheet processing device B based on a mode setting means.

As described above, in the sheet processing device B of the present invention, the following four modes can be specified: (1) "print-out mode", (2) "staple-binding mode", (3) "saddle stitching and folding mode", and (4) "folded sheet pressing mode".

The sheet processing device B includes the sheet processing device controller 115 that is made operable in one of the above four modes, a ROM that stores an operation program, and a RAM that stores control data. The sheet processing device controller 115 includes a sheet conveying controller 116 that controls sheet conveyance in the device, a single-sheet punching controller 117 that applies punching, one by one, the sheets by means of a single-sheet punching unit 28, a processing tray controller 118 that performs control of accumulating the sheets on the processing tray 29, and an end face binding controller 119 that binds the end face side of the sheets accumulated in a bundle and discharges the bound sheet bundle.

The saddle stitching or the center-folding of the sheet at about a half position thereof in the sheet conveying direction is controlled by a stacker section controller 120 that accumulates the sheet bundle in the sheet stacker section 35. The stacker section controller 120 uses the stopper 38 or the aligning means 39 that regulates the leading end of the sheets carried in, one by one, to the stacker section 35 to generate an aligned sheet bundle. The sheet processing device controller 115 further includes a saddle stitching controller 121 that controls the saddle stitching stapler 40 to drive a staple or the like to a center portion of the sheet bundle and a sheet folding controller 122 that controls the folding blade 46 to push the saddle-stitched sheet bundle into the folding roller 45 to fold the sheet bundle.

The sheet processing device controller 115 further includes a folded sheet pressing controller 123 that controls the sheet pressing device according to the thus described "folded sheet pressing mode". The folded sheet bundle BS that has been pressed is discharged and accumulated in the second sheet discharge tray 22 under control of a center-folded sheet discharge controller 124 that controls the folding roller 45 serving also as a bundle conveying roller and the bundle discharge roller 49.

The folded sheet pressing control related especially to the present invention has been described based on the description of the respective mechanisms and using operation state explanatory views of FIGS. 8 to 10 and FIGS. 16 to 20, so descriptions thereof will be omitted. The sheet pressing device 50 is controlled so as to execute the sheet pressing based on the contents described.

The present invention in its preferred embodiments provides the following effects.

(1) There is provided, according to the above embodiment, a sheet processing device including a pair of pressing rollers 70 as a pressing member that press a fold of a folded sheet bundle in a thickness direction of the fold and a pressing roller unit 56 as a moving member that moves the pressing roller pair 70 along the fold of the folded sheet bundle, wherein the pressing roller unit 56 supports a plurality of rows of the pressing roller pairs 70 arranged in a moving direction of the pressing roller unit 56, and the pressing roller pairs 70 press the folded sheet bundle with the intervals therebetween in the respective rows reduced stepwise in the moving direction of the pressing roller unit 56.

With this configuration, the first pressing roller pair 70 in the moving direction is moved in a sheet width direction while pressing the folded sheet bundle in the fold thickness direction in a state of being separated from each other to create a fold, and the second pressing roller pair 70 in the moving direction is moved in the sheet width direction while pressing the folded sheet bundle with the interval therebetween reduced to create a new fold, whereby the fold of the folded sheet bundle is directed inward. Thus, the sheet bundle itself is directed to its binding direction, thereby preventing the folded sheet bundle from being opened after the pressing, which allows more sheet bundles to be accumulated.

(2) In the sheet processing device of (1), the pressing roller pair 70 is a pair of rollers capable of being rotated in accordance with the moving direction.

With this configuration, the pressing roller pair 70 can be rotated in the moving direction, so that it can override the fold from a sheet end portion and press the fold without catch to thereby perform smooth sheet pressing operation.

(3) In the sheet processing device of (2), a plurality of rows of the pressing roller pairs 70 are supported by a frame of the pressing roller unit 56, the pressing roller pair 70 (75, 76) of the last row in the moving direction of the pressing roller unit 56 are elastically biased so as to be brought into pressure contact with each other, and the pressing roller pair 70 (73, 74) of the last row but one is position-regulated so as to prevent the interval therebetween from being made smaller than a predetermined interval.

With this configuration, when pressing folded sheet bundle formed by rigid sheets, the pressing roller pair 70 can set the fold by being moved upward with downward movement thereof regulated by an interval regulating member, whereby the fold can be set at different positions.

(4) In the sheet processing device of (3), the plurality of rows of the pressing roller pairs 70 supported by the frame of the pressing roller unit 56 so as to be arranged in the moving direction of the pressing roller unit 56 are configured such that two rollers constituting the pressing roller pair 70 of each row are disposed opposite to each other, with a sheet fold position as a center, at positions substantially equally distant from the sheet fold position.

With this configuration, the pair of pressing rollers 70 equally approach each other in the sheet thickness direction. Thus, the fold lines created by the pair of pressing rollers 70 are formed at positions substantially equally distant from the sheet fold position, whereby a folded booklet having a good appearance can be created.

(5) In the sheet processing device of (4), the movement of the pressing roller unit 56 along the fold of the folded sheet bundle is continued from when the pressing roller pair 70 (71, 72) of the first row in the moving direction of the pressing roller unit 56 overrides one end portion of the folded sheet bundle until when the pressing roller pair 70 (75, 76) of the last row passes through the other end portion of the folded sheet bundle.

With this configuration, the pressing roller unit 56 can create the folds sequentially while being moved by a distance longer than the width of the folded sheet bundle, whereby a folded booklet having improved pressing effect against the fold can be created.

(6) In the sheet processing device of (5), at least three rows of the pressing roller pairs 70 (71 and 72, 73 and 74, 75 and 76) whose interval differs among the rows are arranged.

With this configuration, the three rows of the pressing roller pairs 70 (71 and 72, 73 and 74, 75 and 76) whose intervals in the respective rows are reduced stepwise is used to perform pressing, so that even in a case where a comparatively thick folded sheet bundle formed by, e.g., 20 to 30 sheets is pressed, it is possible to prevent the fold of the folded sheet bundle from being opened, thereby improving the accumulating property and aligning property.

(7) There is provided, according to the above embodiment, a sheet processing device including a stacker section 35 that accumulates sheets as a sheet bundle, a folding roller 45 that folds the accumulated sheet bundle, a pair of pressing rollers 70 that press a fold of the sheet bundle folded by the folding roller 45 in a thickness direction of the fold, and a pressing roller unit 56 with a frame, serving as a moving member and configured to move the pressing roller pair 70 along the fold of the folded sheet bundle, wherein a plurality of rows of the pressing roller pairs 70 are arranged and unitized inside the frame, intervals between the pressing roller pairs of the respective rows that press the folded sheet bundle in a thickness direction of the fold are reduced stepwise in the moving direction of the frame, and the frame is moved in the moving direction thereof to cause the pressing roller pairs of respective rows to press the folded sheet bundle from both sides in the thickness direction of the fold.

With this configuration, there are arranged, inside the frame of the pressing roller unit 56 that is moved along the fold, the plurality of rows of the pressing roller pairs 70 whose intervals in the respective rows are reduced stepwise in the moving direction of the frame, thereby preventing in a stepwise manner the folded sheet bundle from being opened, which suppresses the accumulated folded sheet bundle from being opened. Thus, the accumulating property and aligning property of the folded sheet bundle can be improved. Further, the plurality of rows of the pressing roller pairs 70 whose intervals in the respective rows are reduced stepwise are supported inside the frame, so that effective stepwise sheet pressing can be performed only by a single movement operation in the sheet width direction.

(8) In the sheet processing device of (7), among the plurality of rows of the pressing roller pairs, at least the pressing roller pair 70 (75, 76) of the last row in the moving direction are elastically biased against each other.

With this configuration, the pressing roller pair 70 (75, 76) of the last row are elastically biased against each other, so that the roller pair of the last row is moved along the fold while pressing the fold, thereby enhancing the fold of the folded sheet bundle.

(9) There is provided, according to the second embodiment, a sheet processing device (sheet processing device B) including a pair of pressing rollers 70 as a pressing member that press a fold of a folded sheet bundle in a thickness direction of the fold and a pressing roller unit 56 as a moving member that moves the pressing roller pair 70 along the fold of the folded sheet bundle, wherein a plurality of the pressing roller units 56 are provided, each of the plurality of pressing roller units 56 (56*a*, 56*b*, 56*c*) supports the pressing roller pair 70, intervals between the pressing roller pair 70 supported by the pressing roller unit 56*a* that is moved first and between the pressing roller pair 70 supported by the pressing roller unit 56*a* that is moved next are reduced stepwise, and the pressing roller units 56 are sequentially moved along the fold of the folded sheet bundle to press the folded sheet bundle.

With this configuration, the first pressing roller unit 56*a* in the moving direction is moved in a sheet width direction while pressing the folded sheet bundle in the fold thickness direction in a state where the pair of pressing rollers 70 are separated from each other to create a fold, and the second pressing roller unit 56*b* in the moving direction is moved in the sheet width direction while pressing the folded sheet bundle with the interval between the pair of pressing rollers 70 supported therein reduced to create a new fold, whereby the fold of the folded sheet bundle is directed inward. Thus, the sheet bundle itself is directed to its binding direction, thereby preventing the folded sheet bundle from being opened after the pressing, which allows more sheet bundles to be accumulated.

(10) In the sheet processing device of (9), the pressing roller pair 70 is a pair of pressing rollers capable of being rotated in accordance with the moving direction, and the pair of pressing rollers 75 and 76 of the last row in the moving direction are elastically brought into pressure contact with each other.

With this configuration, the pressing roller pair 70 can be rotated in the moving direction, so that it can override the fold from a sheet end portion and press the fold without catch to thereby perform smooth sheet pressing operation. Further, the pair of pressing rollers 70 (75, 76) of the last row in the moving direction are elastically biased against each other by springs, so that the roller pair of the last row is moved along the fold while pressing the fold, thereby enhancing the fold of the folded sheet bundle.

(11) There is provided, according to the embodiment, an image forming device A including an image forming means for forming an image on a sheet and a sheet processing device that applies predetermined sheet processing to the image-formed sheet from the image forming means, wherein the sheet processing device is the sheet processing device B described in (1).

With this configuration, there can be provided the image forming device A having the sheet processing device B capable of providing working effects described in the above respective paragraphs.

(12) There is provided, according to the embodiment, a sheet pressing method of a sheet pressing device including a pair of pressing rollers 70 as a pressing member that press a fold of a folded sheet bundle in a thickness direction of the fold and a pressing roller unit 56 as a moving member that moves the pressing roller pair 70 along the fold of the folded sheet bundle, wherein the pressing roller unit 56 supports a plurality of rows of the pressing roller pairs 70 arranged in their moving direction, intervals between the pressing roller pairs 70 of the respective rows are reduced stepwise from first row to the last row in the moving direction, and the pressing roller unit 56 supporting the configured pressing roller pairs are moved with the first pressing roller pair, the interval between which is largest, in front to press the folded sheet bundle.

With this configuration, the sheet bundle itself is directed to its binding direction, thereby preventing the folded sheet bundle from being opened after the pressing, which allows more sheet bundles to be accumulated.

In the description of the effects of the embodiments, reference numerals are given to constituent elements recited in the claims so as to clarify a correspondence relationship between the description of "Detailed Description" and the description of "What is Claimed is".

Further, it should be appreciated that the present invention is not limited to the present embodiment, and various modifications may be made thereto. Further, all technical matters included in the technical ideas set forth in the claims should be covered by the present invention. While the invention has been described based on a preferred embodiment, those skilled in the art can realize various substitutions, corrections, modifications, or improvements may be made from the content disclosed in the specification by a person skilled in the art, which are included in the scope defined by the appended claims.

This application is based upon and claims the benefit of priority from prior Japanese Patent Applications No. 2014-133796 and No. 2014-133798, both filed Jun. 30, 2014, the entire contents of which are incorporated herein by reference.

What is claimed is:

1. A sheet processing device that presses a folded sheet bundle, comprising:

a plurality of pairs of sheet pressing members, each pair of sheet pressing members including an interval therebetween for sandwiching a fold of the folded sheet bundle and pressing the folded sheet bundle in a thickness direction of the folded sheet bundle; and a moving member that moves the plurality of pairs of sheet pressing members along the fold of the folded sheet bundle, wherein the moving member supports the plurality of pairs of sheet pressing members, wherein each pair of sheet pressing members is supported by the moving member in a row at a different position along a moving direction of the moving member, the interval between each pair of sheet pressing members is regulated based on the position of each pair of sheet pressing members on the moving member, such that a first pair of the plurality of pairs of sheet pressing members has an interval larger than a next pair of the plurality of pairs of sheet pressing members, and the moving member moves in the moving direction so that each pair of sheet pressing members forms another fold on the folded sheet bundle and simultaneously presses the fold of the folded sheet bundle.

2. The sheet processing device according to claim 1, wherein each pair of the plurality of pairs of sheet pressing members is a pair of pressing rollers, the each pair of pressing rollers being capable of being rotated in accordance with the moving direction of the moving member.

3. The sheet processing device according to claim 2, wherein the plurality of pairs of pressing rollers is supported in a plurality of rows in the moving direction and the plurality of pairs of pressing rollers includes a pair of pressing rollers in a last row and a pair of pressing rollers adjacent to the pair of pressing rollers in the last row, so that the pair of pressing rollers in the last row in the moving direction is elastically biased so as to be brought into pressure contact with each other, and the pair of pressing rollers adjacent to the pair of pressing rollers in the last row is position-regulated so as to prevent the interval therebetween from becoming narrower than a predetermined interval.

4. The sheet processing device according to claim 3, wherein the plurality of pairs of pressing rollers supported by the moving member in the plurality of rows in the moving direction of the moving member is configured such that one roller of each pair of pressing rollers is disposed opposite the other roller of each pair of pressing rollers, with a position of the fold as a center, at positions substantially equally distant from the position of the fold.

5. The sheet processing device according to claim 4, wherein the plurality of pairs of pressing rollers includes a pair of pressing rollers in a first row, and a movement of the moving member along the fold of the folded sheet bundle is continued from when the pair of pressing rollers in the first row in the moving direction overrides one end portion of the folded sheet bundle until when the pair of pressing rollers in the last row passes through another end portion of the folded sheet bundle.

6. The sheet processing device according to claim 5, wherein the interval of each pair of pressing rollers is regulated so that the interval between the pair of pressing rollers in the first row is defined as L1, the interval between the pair of pressing rollers adjacent to the pair of pressing rollers in the last row is defined as L2 being narrower than L1, and the pair of pressing rollers in the last row pressure contacts each other.

7. An image forming device comprising:

an image forming unit that forms an image on a sheet; and a sheet processing device that applies a predetermined sheet processing to an image-formed sheet from the image forming unit, wherein the sheet processing device is the sheet processing device as claimed in claim 1.

8. A sheet processing device that presses a folded sheet bundle, comprising:

a stacker section that accumulates sheets as a sheet bundle;

a folding roller that nips and folds the sheet bundle accumulated on the stacker section to form the folded sheet bundle with a fold;

a plurality of pairs of pressing rollers, each pair of pressing rollers having a first roller facing a second roller with an interval therebetween for sandwiching the fold of the folded sheet bundle formed by the folding roller, and pressing the folded sheet bundle in a thickness direction of the folded sheet bundle; and a moving member with a frame that supports the plurality of pairs of pressing rollers, sandwiches the fold of the folded sheet bundle, and moves along the fold of the folded sheet bundle, wherein the frame is arranged to sandwich the fold of the folded sheet bundle between the plurality of pairs of pressing rollers, wherein each pair of pressing rollers is arranged in a row, the plurality of rows positioned in different locations on the frame along a moving direction of the moving member, to press two sides of the folded sheet bundle in the thickness direction with the plurality of pairs of pressing rollers wherein the interval between each pair of pressing rollers is regulated to be different from the interval of the other pairs of pressing rollers in the plurality of pairs of pressing rollers, wherein the interval between each pair of pressing rollers is regulated based on the position of each pair of pressing rollers on the frame, such that a first pair of the plurality of pairs of pressing rollers has an interval larger than a second pair of the plurality of pairs of pressing rollers, and to move in the moving direction along the fold of the folded sheet bundle so that each pair of the plurality of pairs of pressing rollers presses the fold of the folded sheet bundle formed by the folding roller and simultaneously forms another fold on the folded sheet bundle.

9. The sheet processing device according to claim 8, wherein the plurality of pairs of pressing rollers includes a last pair of the plurality of pairs of pressing rollers in a last row, and the interval of each pair of pressing rollers is regulated so that the interval between the first pair of the plurality of pairs of pressing rollers in a first row, which is on a side of the moving member closest to the fold of the folded sheet bundle, is defined as L1, the interval between the second pair of the plurality of pairs of pressing rollers in a second row after the first row is defined as L2 being narrower than L1, and the last pair of the plurality of pairs of pressing rollers in the last row pressure contacts each other.

10. The sheet processing device according to claim 8, wherein an elastic member is provided between each pair of pressing rollers and the frame to urge the respective each pair of pressing rollers toward the folded sheet bundle, and by a regulating member maintaining the interval between each pair of pressing rollers, each pair of pressing rollers presses the folded sheet bundle at different positions.

11. The sheet processing device according to claim 10, wherein the regulating member is a supporting groove provided at the frame supporting a shaft of each pair of pressing rollers.

12. A sheet processing device that presses a folded sheet bundle, comprising:

a plurality of pairs of pressing rollers, each pair of pressing rollers having a first roller facing a second roller with an interval therebetween for sandwiching a fold of the folded sheet bundle and pressing the folded sheet bundle in a thickness direction of the folded sheet bundle, and a plurality of moving members, wherein each moving member supports each pair of the plurality of pairs of pressing rollers, sandwiches the fold of the folded sheet bundle, and moves along the fold of the folded sheet bundle, wherein each moving member of the plurality of moving members includes a frame moving respectively along the fold of the folded sheet bundle and supporting corresponding pair of pressing rollers, the interval between each pair of pressing rollers is regulated based on the position of each frame, such that a first pair of the plurality of pairs of pressing rollers supported by a first frame of the plurality of frames has an interval larger than a second pair of the plurality of pairs of pressing rollers supported by a second frame of the plurality of frames, and when each frame of the plurality of frames moves in a first direction along the fold of the folded sheet bundle, the folded sheet bundle is pressed to form another fold and to press the fold of the folded sheet bundle by moving each of the plurality of pairs of pressing rollers.

13. The sheet processing device according to claim 12, wherein each frame of the plurality of frames continuously moves in the first direction when moving along the fold of the folded sheet bundle, to form the another fold and simultaneously to press the fold of the folded sheet bundle.

14. The sheet processing device according to claim 12, wherein the plurality of pairs of pressing rollers includes a last pair supported by a last frame of the plurality of frames arranged last, and the interval of each pair of the plurality of pairs of pressing rollers is regulated so that the interval between the first pair of the plurality of pairs of pressing rollers supported by the first frame closest to the fold of the folded sheet bundle is defined as L1, the interval between the second pair of the plurality of pairs of pressing rollers arranged after the first pair of the plurality of pairs of pressing rollers is defined as L2 being narrower than L1, and the last pair of the plurality of pairs of pressing rollers arranged last pressure contacts each other.

15. A sheet pressing method of a sheet processing device including a stacker section that accumulates sheets as a sheet bundle, a folding roller that nips and folds the sheet bundle accumulated on the stacker section to form a folded sheet bundle with a fold, a plurality of pairs of pressing rollers, each pair of pressing rollers having a first roller facing a second roller with an interval therebetween for sandwiching the fold of the folded sheet bundle formed by the folding roller and pressing the folded sheet bundle in a thickness direction of the folded sheet bundle, and a moving member with a frame that supports the plurality of pairs of pressing rollers, sandwiches the fold of the folded sheet bundle, and moves along the fold of the folded sheet bundle, wherein an interval between one pair of pressing rollers is regulated to be different from an interval between another pair of pressing rollers in the plurality of pairs of pressing rollers, the sheet pressing method for pressing the folded sheet bundle while the frame moves toward a first direction from a starting end to an ending end of the fold of the folded sheet bundle, comprising:

a first pressing step of moving the frame supporting the pair of pressing rollers such that the folded sheet bundle is pressed by a pair of pressing rollers in the plurality of pairs of pressing rollers where an interval therebetween is regulated to a widest interval, and forming a first fold separately from the fold formed by the folding roller, and a second pressing step of continuously moving the another frame supporting the pair of pressing rollers and starting forming a second fold between the fold formed by the folding roller and the first fold formed during the first pressing step by a pair of pressing rollers where an interval therebetween is regulated to that next to the widest interval.

16. The sheet pressing method according to claim 15, further comprising:

a third pressing step, following the first pressing step and the second pressing step, in a course of moving the frame from the starting end to the ending end of the fold of the folded sheet bundle, of additionally increasing pressing of the fold formed from the folding roller by a pair of pressing rollers having an interval not being regulated.

* * * * *